US009097389B2

(12) United States Patent
Goodson

(10) Patent No.: US 9,097,389 B2
(45) **Date of Patent: *Aug. 4, 2015**

(54) APPARATUS AND METHOD FOR DETECTION AND CESSATION OF UNINTENDED GAS FLOW

(75) Inventor: Mark E. Goodson, Corinth, TX (US)

(73) Assignee: GOODSON HOLDINGS, LLC, Denton, TX (US)

( * ) Notice: Subject to any disclaimer, the term of this patent is extended or adjusted under 35 U.S.C. 154(b) by 499 days.

This patent is subject to a terminal disclaimer.

(21) Appl. No.: 13/596,972

(22) Filed: Aug. 28, 2012

(65) Prior Publication Data

US 2013/0014830 A1 Jan. 17, 2013

Related U.S. Application Data

(63) Continuation-in-part of application No. 13/279,932, filed on Oct. 24, 2011, now Pat. No. 8,905,058, which is a continuation-in-part of application No. 12/534,455, filed on Aug. 3, 2009, now Pat. No. 8,251,085.

(51) Int. Cl.
*F17D 5/08* (2006.01)

(52) U.S. Cl.
CPC ..... *F17D 5/08* (2013.01); *Y10T 137/0318* (2015.04); *Y10T 137/1915* (2015.04)

(58) Field of Classification Search
CPC ..... F16K 17/36; F17D 5/08
USPC ..... 137/78.1, 78.4, 78.5; 251/65–71, 251/129.01, 129.04; 340/601, 659; 324/72, 324/72.5
See application file for complete search history.

(56) References Cited

U.S. PATENT DOCUMENTS

| | | | | |
|---|---|---|---|---|
| 5,388,606 | A * | 2/1995 | Banks | 137/38 |
| 7,044,167 | B2 | 5/2006 | Rivest | |
| 7,367,364 | B2 | 5/2008 | Rivest et al. | |
| 7,821,763 | B2 | 10/2010 | Goodson | |
| 8,203,820 | B2 * | 6/2012 | Khonkar | 361/160 |
| 8,905,058 | B2 * | 12/2014 | Goodson | 137/78.1 |

* cited by examiner

*Primary Examiner* — Eric Keasel
(74) *Attorney, Agent, or Firm* — David W. Carstens; Jeffrey G. Degenfelder; Carstens & Cahoon, LLP

(57) ABSTRACT

A method and apparatus for detecting and preventing electrically induced fires in a gas tubing systems constructed of Corrugated Stainless Steel Tubing (CSST) and Gas Appliance Connectors (GAC). The system of the present invention may include one or more energy detection schemes to detect electrical energy surges on the gas line. When such a surge is detected, the control circuitry of the present invention causes an electric two-way main gas valve to de-energize into a position wherein the flow of gas from a gas feeder pipe to the gas tubing system is blocked and residual gas pressure in the gas tubing system is automatically vented to the atmosphere.

28 Claims, 15 Drawing Sheets

APPARATUS AND METHOD FOR DETECTION AND CESSATION OF UNINTENDED GAS FLOW

CROSS-REFERENCE TO RELATED APPLICATION

This application is a continuation-in-part of U.S. patent application Ser. No. 13/279,932 filed Oct. 24, 2011, which is a continuation-in-part of U.S. patent application Ser. No. 12/534,455 filed Aug. 3, 2009, the technical disclosures of which are hereby incorporated herein by reference.

BACKGROUND OF THE INVENTION

1. Technical Field of the Invention

The present invention relates generally to the prevention of fires caused by lightning and more specifically to fires involving gas leaks in Corrugated Stainless Steel Tubing and similar gas lines (sometimes referred to as appliance connectors).

2. Description of the Related Art

Corrugated Stainless Steel Tubing (CSST) is a relatively new building product used to plumb structures for fuel gas (e.g., propane or natural gas) in lieu of conventional black pipe. The advantages that are offered for CSST include a lack of connection and a lack of threading. In essence, it is a material that results in substantial labor savings relative to using black pipe.

The use of Corrugated Stainless Steel Tubing (CSST) to serve as a conduit for delivering fuel gas within residential and commercial buildings has been recognized by the National Fuel Gas Code (NFPA 54) since about 1988. Various code bodies and regulatory agencies have allowed the use of CSST in such structures.

CSST differs from black pipe in a number of ways. In a CSST system, gas enters a house at a pressure of about 2 psi and is dropped to ~7" WC by a regulator in the attic (assuming a natural gas system). The gas then enters a manifold and is distributed to each separate appliance via "home runs." Unlike black pipe, a CSST system requires a separate run for each appliance. For example, a large furnace and two water heaters in a utility closet will require three separate CSST runs. With black pipe, the plumber may use only one run of 1" pipe and then tee off in the utility room. Therefore, the requirement of one home run per appliance significantly increases the number of feet of piping in a building.

CSST is sold in spools of hundreds of feet and is cut to length in the field for each run. In this regard, CSST has no splices or joints behind walls that might fail. CSST also offers an advantage over black pipe in terms of structural shift. With black pipe systems, the accommodations for vibrations and/or structural shifts are handled by appliance connectors, a form of flexible piping.

Unfortunately, a major drawback to the use of CSST is the propensity for it to fail when exposed to an electrical insult such as from a lightning strike to an adjacent structure. CSST is very thin, with walls typically about 10 mils in thickness. The desire for easy routing of the tubing necessitates this lack of mass. However, it also results in a material through which electricity can easily puncture. Once the tubing has been perforated, it is possible for the escaping gas to be ignited by the metallic by-products of the arcing process, by auto-ignition, or by adjacent open flames.

For example, when subjected to significant electrical insult such as a lightning strike, CSST typically develops holes which act as orifices for raw fuel gas leakage. Field data indicates that lightning damage to black pipe is sometimes so small that it is often only visible with microscopic analysis and limited to a small pit that does not leak. However, lightning strikes involving CSST create leaks that vary from pinhole size to almost quarter inch holes. The electrical arcing process, which causes the insult and resultant gas leak from the CSST, will often ignite the gas, effectively turning the gas leak into a blowtorch. This phenomenon is described by the inventor's two papers on the subject, "CSST and Lightning," Proceedings, *Fire and Materials* 2005 *Conference*, January 2005, and "The Link Between Lightning, CSST, and Fires," *Fire and Arson Investigator*, October 2005, the contents of which are hereby incorporated by reference.

Lightning strikes vary in current from 1,000 (low end) to 10,000 (typical) to 200,000 (maximum) amperes peak. Mechanical damage caused by heating is a function of the current squared multiplied by time. Thus, the current is the dominant factor creating the melting of gas tubing.

One of the underlying issues with CSST is that it is part of the electrical grounding system. For reasons of electric shock prevention (and also elimination of sparks associated with static electricity), it is desirable to have all exposed metal within a structure bonded so that there are no differences of potential. However, there are limitations to applying DC circuit theory (or even 60 Hz steady state phasor theory) in this situation because lightning is known to have fast wavefronts. While the reaction of large wires and irregular surfaces is predictable at 60 Hz, the fast wave fronts associated with lightning may cause substantial problems with CSST, given its corrugated surface. Moreover, new house construction has shown very tight bends and routing of CSST immediately adjacent to large ground surfaces, creating the potential for arcs created by lightning strikes. Testing of CSST under actual installed conditions using transient waveforms may well show further limitations that conventional bonding and grounding cannot accommodate.

The typical gas line or gas system, whether black pipe or CSST, is usually not a good ground. The metal components that make up a gas train are made from materials that are chosen for their ability to safely carry natural gas (or propane) and the accompanying odorant. These metallic components are not known for their ability to carry electric current. To further compound matters, it is not uncommon to find pipe joints treated with Teflon tape or plumber's putty, neither of which is considered an electrical conductor. The Fuel Gas Code (NFPA 54) calls for above ground gas piping systems to be electrically continuous and bonded to the grounding system. The code provision also prohibits the use of gas piping as the grounding conductor or electrode.

Gas appliance connectors (GAC), which are prefabricated corrugated gas pipes, are also known to fail from electric current, whether this current is from lightning or from fault currents seeking a ground return path. These connectors usually fail by melting at their ends (flares) during times of electrical overstress. These appliance connectors are better described ANSI Z21.24, *Connectors for Indoor Gas Appliances*, the contents of which are hereby incorporated by reference. A gas appliance that is not properly grounded is more susceptible to gas line arcing than a properly grounded appliance. The exact amount of fault current, however, will depend upon the impedances of the several ground paths and the total fault current that is available. For example, air handlers for old gas furnaces seem to be the most prone. Typically, an inspection will reveal that the power for the blower motor uses a two-conductor (i.e., non-grounded) power cord.

A variety of proposals have previously been made to alleviate this problem with the use of CSST by changing certain characteristics of the CSST piping itself. For example, U.S.

Pat. Nos. 7,044,167 and 7,367,364 to Rivest disclose polymer jackets encasing the CSST while U.S. Pat. No. 7,821,763 to Goodson discloses a novel electrical shunt device for coupling gas appliances to the CSST. The shunt causes the charge on the CSST (or appliance connector) wall to be dissipated over a larger area. However, the aforementioned proposals work for CSST piping that is manufactured with these patented characteristics, they do not alleviate the problems that exist for the many buildings already plumbed with standard (i.e., conventional) CSST or GACs.

There exist from some manufacturers devices known as excess gas flow valves. These devices detect excess gas flow and cut off the gas pressure if, as an example, a gas pipe breaks and gas flows unabated through an open pipe. However, holes caused by lighting on CSST are relatively small, and can easily mimic a 35,000 BTU/hour gas appliance, such as a water heater. For this reason, excess gas flow valves do not sufficiently address the lightning problem.

Therefore, it would be desirable to have a gas conduit system incorporating CSST or a GAC that is capable of preventing fires caused by auto-ignition of gas leaks resulting from electrical insult to the gas tubing. Moreover, it would be desirable if such a system could prevent or minimize fires caused by such auto-ignition of gas leaks by rapidly dispersing any pressurized gas remaining in the gas tubing to the outside atmosphere.

SUMMARY OF THE INVENTION

The present invention is designed to be retrofit into buildings that are already plumbed and constructed with standard (i.e., conventional) CSST or GACs. Embodiments of the invention may further include multiple energy detection schemes to detect electrical energy surges on the gas line. In contrast to conventional excess gas flow valves, which work by sensing gas flow, the embodiments of the present invention are triggered by sensing electrical insult. In one embodiment, the present invention provides an automated failsafe system for cutting off gas flow in response to electrical insults that may damage gas tubing. The invention uses an inductive sensor to detect electrical surges along a ground conductor that provides a ground path for gas tubing. The sensor is coupled to control circuitry that provides a continuous pulse train to a solenoid that forms part of a valve that controls gas flow through the gas tubing. The pulse train from the control circuitry keeps the valve open. In response to an electrical surge detected along the ground conductor (e.g., from lightning), the control circuitry stops the pulse train to the solenoid, which in turn causes the gas valve to close and stop the gas flow to the tubing. If the intensity of a lightning strike is strong enough to destroy semiconductor junctions in the circuitry, the circuitry will cease to function properly, thereby failing in a safe manner and removing current to the solenoid. This will cause the main gas valve to close, thereby avoiding gas leakage through any perforations in the CSST that may have resulted from the electrical insult.

In a second embodiment, the present invention provides not only an automated failsafe system for cutting off gas flow in response to electrical insults that may damage gas tubing, but also a residual gas dispersal system that quickly disperses residual pressurized gas in the downstream system. The automated cut-off system of the second embodiment may include multiple energy detection schemes to detect electrical energy surges on the gas line. The activation of any one of the energy detection schemes is sufficient to stop gas flow. The system detects whether electrical energy in the form of lightning currents or 60 Hz energy, is flowing along the gas piping system. In that lightning can damage CSST and cause leaks (and resultant fires), the second embodiment of the invention minimizes this risk by closing the main gas valve cutting off gas flow to the gas piping system. While cutting off the flow of gas to the gas piping system greatly reduces the risk of fires caused by lightning induced damage to CSST and GCAs, it has been found that the residual gas pressure in the closed-off gas system can still support any resulting flame for several seconds to several minutes depending upon the pressures and size of the gas system (i.e., how many feet of pipe and what is the diameter of that pipe).

A pinhole formed in the CSST from the lightning insult may subsequently result in a flame that lasts for several seconds to several minutes, depending amount and pressure of the residual gas left in the downstream gas piping system after the main gas valve is closed. The present invention helps minimizes this risk by temporarily opening a secondary bleed-off gas valve. The secondary relief valve drains the closed-off gas piping system of residual pressure by opening and dumping the residual pressurized gas through an open pipe into atmospheric air. The internal diameter of this gas valve presents much less of an obstruction than does the lightning created orifice. Consequently, the vast majority of the residual gas exits out of the newly opened gas valve instead of the small lightning created orifice.

Thus, the system circuitry of the second embodiment of the invention has several novel features. Separate detection circuits are utilized for both lightning and fugitive currents. This multiplicity of detection schemes helps to insure that electrical energy on the gas piping can be detected, despite differing modalities. The design calls for a constant changing of state (i.e., the pulsing) so as to maintain gas flow. Should the timer/oscillator stop, or should the drive transistor (as an example) short or open, gas flow stops. The relief of residual gas pressure in the event of energy detection helps to insure that gas flow from any electrically induced breach is minimized by venting the residual gas to atmosphere through a controlled vent and not through the hole created by the electrical energy. While the circuitry described makes use of contact (voltage drop) and non contact (induction means) for sensing electrical current, there is nothing to prevent the induction loop or the voltage drop circuitry from being replaced by a Hall effect device. Similarly, the contact method of current sensing can be accomplished through the use of optical isolators.

The system circuitry of the second embodiment of the invention includes several novel features. Separate detection circuits are utilized for both lightning and fugitive currents. This multiplicity of detection schemes helps to insure that electrical energy on the gas piping can be detected, despite differing modalities. The design calls for a constant changing of state (i.e., the pulsing) so as to maintain gas flow. Should the timer/oscillator stop, or should the drive transistor (as an example) short or open, gas flow stops. The relief of residual gas pressure in the event of energy detection helps to insure that gas flow from any electrically induced breach is minimized by venting the residual gas to atmosphere through a controlled vent and not through the hole created by the electrical energy. While the circuitry described makes use of contact (voltage drop) and non contact (induction means) for sensing electrical current, there is nothing to prevent the induction loop or the voltage drop circuitry from being replaced by a Hall effect device. Similarly, the contact method of current sensing can be accomplished through the use of optical isolators.

A third embodiment of the present invention comprises a variant of the second embodiment, and includes a special two-way or "tee" valve in place of the standard main gas valve and secondary bleed-off valve combination used in the second embodiment. While the second embodiment of the invention made use of two separate one-way valves, one for delivering main gas pressure flow to the gas system and one for bleeding off residual pressure after electrical insult, the third embodiment of the present invention combines the two one-way gas valves into a single combination or tee valve. The tee valve is coupled with an electrical solenoid, which acts as its actuating means. When the solenoid is energized (i.e., configured in a first position), the tee valve allows gas pressure to flow from the main gas supply system (e.g., from the utility or the propane tank) to the gas manifold and various gas appliances. Upon recognition by the invention of an electrical insult, power to the solenoid is removed. The tee valve is biased (e.g., by way of spring action), so that when power to the solenoid is removed the tee valve reverts to a second position wherein the gas flow from the main gas supply (e.g., utility line or propane tank) is blocked by the tee valve. When blocking the flow of gas from the main gas supply, the tee valve is also designed to concurrently open the downstream gas lines and gas manifold to open air. Thus, when configured in the second position, the tee valve allows the residual pressure in the downstream gas lines to bleed off to open air which substantially lessens the gas pressure and gas flow to the artificially created orifice resulting from lighting or electrical insult to the piping system. The internal passageway diameter of the tee valve presents much less of an obstruction than does the lightning-created orifice. Consequently, when the tee valve reverts to the second position or configuration the vast majority of the residual gas exits through the tee valve instead of the small lightning-created orifice.

The system circuitry of the third embodiment of the invention is similar to that of the second embodiment with some minor modifications and simplifications. As with the second embodiment, separate detection circuits are utilized for both lightning and fugitive currents. This multiplicity of detection schemes helps to insure that electrical energy on the gas piping can be detected, despite differing modalities. The design calls for a constant changing of state (i.e., the pulsing) so as to maintain gas flow. Should the timer/oscillator stop, or should the drive transistor (as an example) short or open, power is removed from the activating solenoid coupled with the tee valve. Upon power being removed from the activating solenoid, the biasing means causes the tee valve to revert to its second position, thereby blocking gas flow from the main gas supply and venting residual gas pressure through a controlled vent to open air. The relief of residual gas pressure in the event of energy detection helps to insure that gas flow from any electrically induced breach is minimized by venting the residual gas to atmosphere through a controlled vent and not through the hole created by the electrical energy. While the circuitry described makes use of contact (e.g., voltage drop) and non contact (e.g., induction means) for sensing electrical current, there is nothing to prevent the induction loop or the voltage drop circuitry from being replaced by a Hall effect device. Similarly, the contact method of current sensing can be accomplished through the use of optical isolators.

BRIEF DESCRIPTION OF THE DRAWINGS

A more complete understanding of the method and apparatus of the present invention may be had by reference to the following detailed description when taken in conjunction with the accompanying drawings, wherein.

Figure 1:
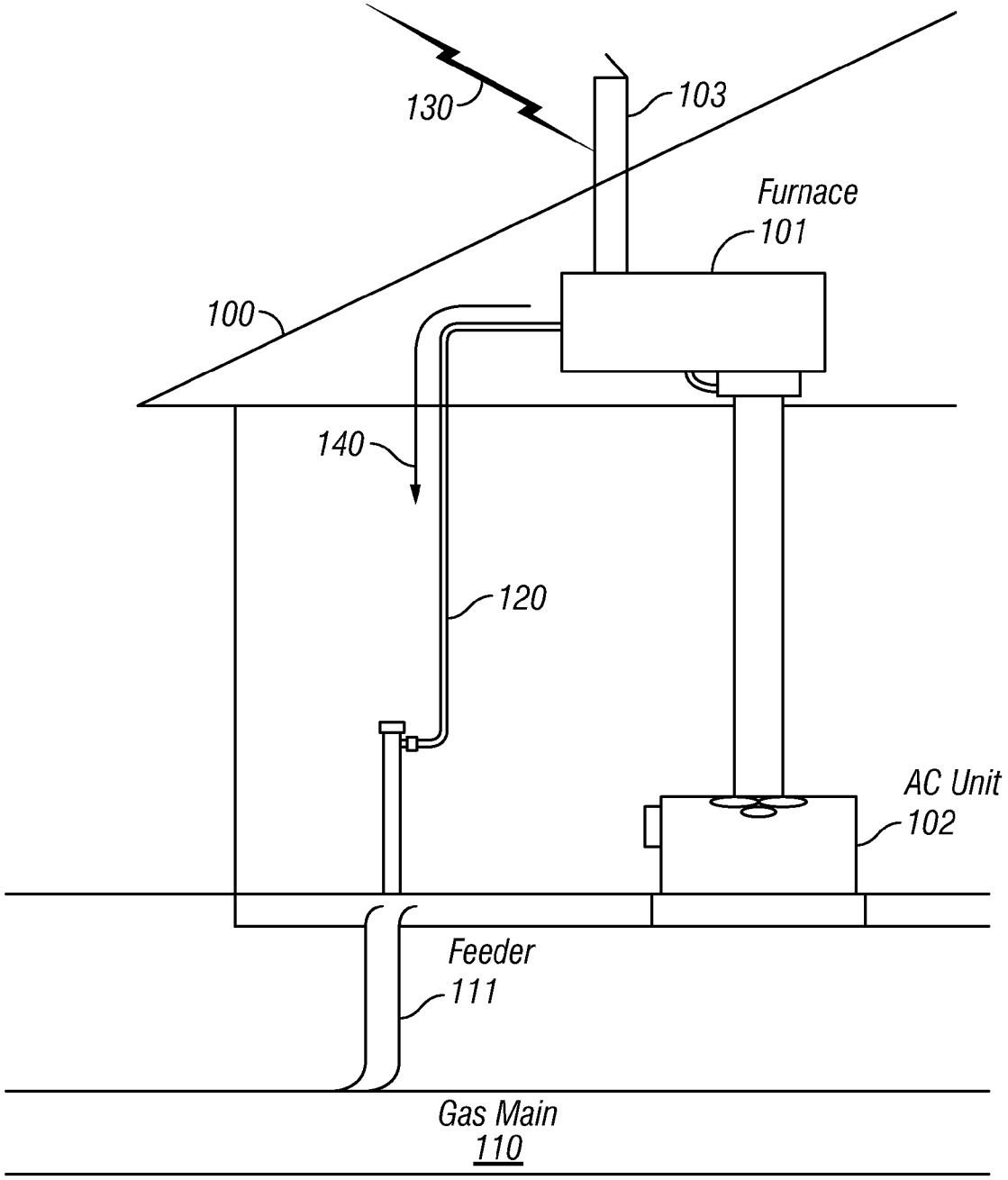
FIG. 1 shows a partial cross section a house illustrating the mechanical connection between the gas line, furnace and air conditioning system.

Where used in the various figures of the drawing, the same numerals designate the same or similar parts. Furthermore, when the terms "top," "bottom," "first," "second," "upper," "lower," "height," "width," "length," "end," "side," "horizontal," "vertical," and similar terms are used herein, it should be understood that these terms have reference only to the structure shown in the drawing and are utilized only to facilitate describing the invention.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

DETAILED DESCRIPTION OF THE INVENTION

FIGS. 1-4 illustrate common scenarios for electrically induced gas fires involving Corrugated Stainless Steel Tubing (CSST).

FIG. 1 shows a partial cross section a house illustrating the mechanical connection between the gas line, furnace and air conditioning system. In this example, the furnace 101 is located in the attic of the house 100. The air conditioning unit 102 is located at ground level. Gas from the gas main 110 enters the house 100 through a feeder line 111. A CSST line 120 connects the feeder 111 to the furnace 101.

The metal chimney 102 of the furnace 101 extends through the roof. If this chimney 103 is struck by lightning 130, the charge will often go to ground through the CSST line 120 as indicated by arrow 140.

Figure 2:
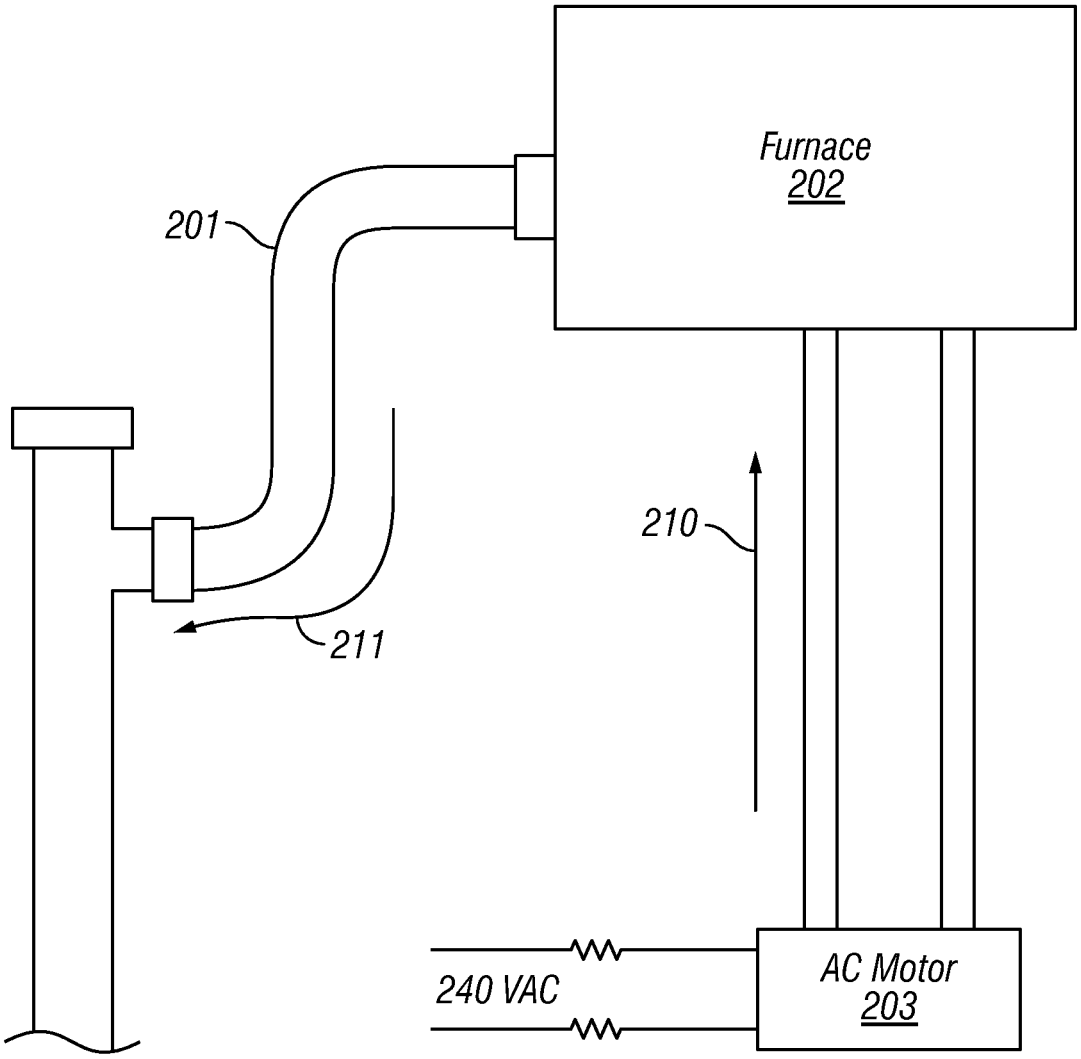
FIG. 2 illustrates another scenario for a CSST or gas appliance connector related gas fire in which the fire is induced by an electrical short from an appliance.

FIG. 2 illustrates another scenario for a CSST or gas appliance connector related gas fire in which the fire is induced by an electrical short from an appliance. FIG. 2 shows an arrangement similar to that in FIG. 1 involving a CSST line 201, a furnace 202 and an A/C unit 203. If the A/C motor 203 becomes stuck the windings in it burn out and short to ground though their physical connection to the furnace 202 and CSST line 201 as indicated by arrows 210, 211.

Figure 3:
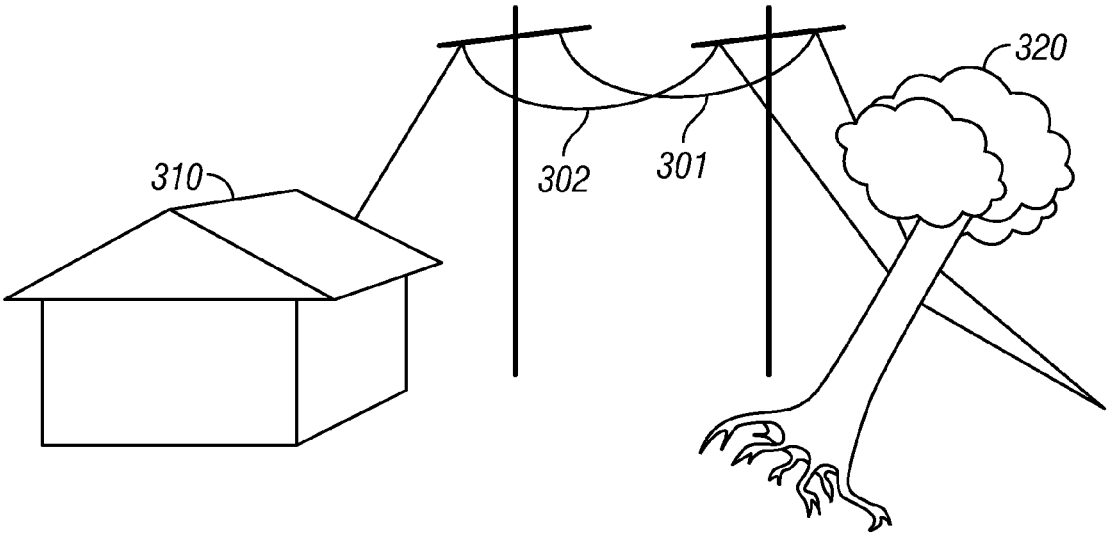
FIG. 3 shows yet another situation in which electrical grounding can damage CSST lines.

FIG. 3 shows yet another situation in which electrical grounding can damage CSST lines. In this example, a tree 320 has fallen across two power lines 301, 302 connected to a house 310. The tree 320 causes the high volt line 301 and the ground line 302 to touch together. In this situation the ground line 302 becomes energized and spills current through the entire house 310, which can result in the electrical current grounding through CSST lines as illustrated in FIGS. 1 and 2.

Figure 4:
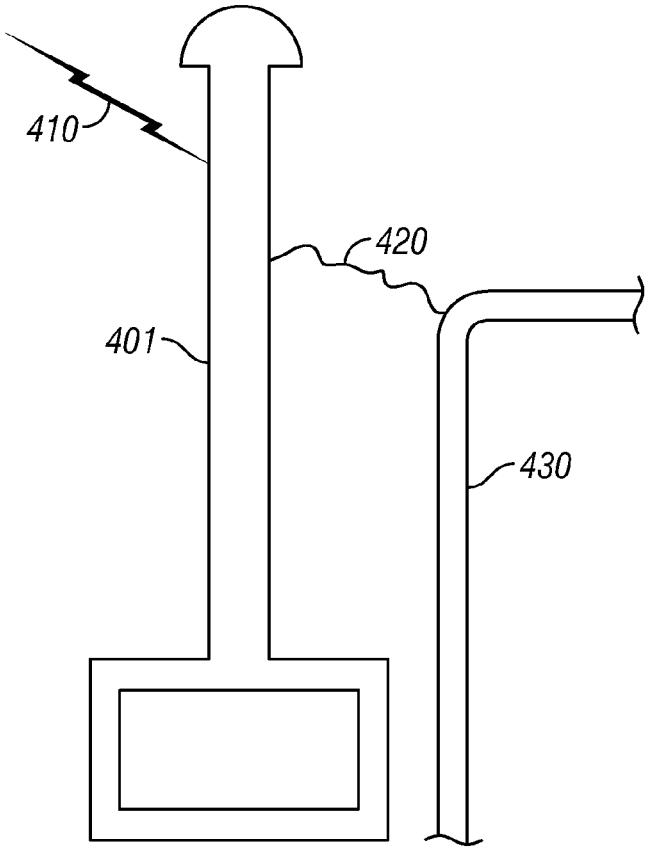
FIG. 4 depicts an example of a CSST perforation caused by electrical arcing.

FIG. 4 depicts an example of a CSST perforation caused by electrical arcing. In this case, the CSST 430 runs parallel to a metal chimney 401 but is not in direct physical contact with the chimney. If the chimney 401 is struck by lightning 410, the potential difference created by the lightning strike might be large enough to produce an electrical arc 420 between the chimney and the CSST 430. Such electrical arcing is most likely to produce perforation along the length of the CSST.

Figure 5:
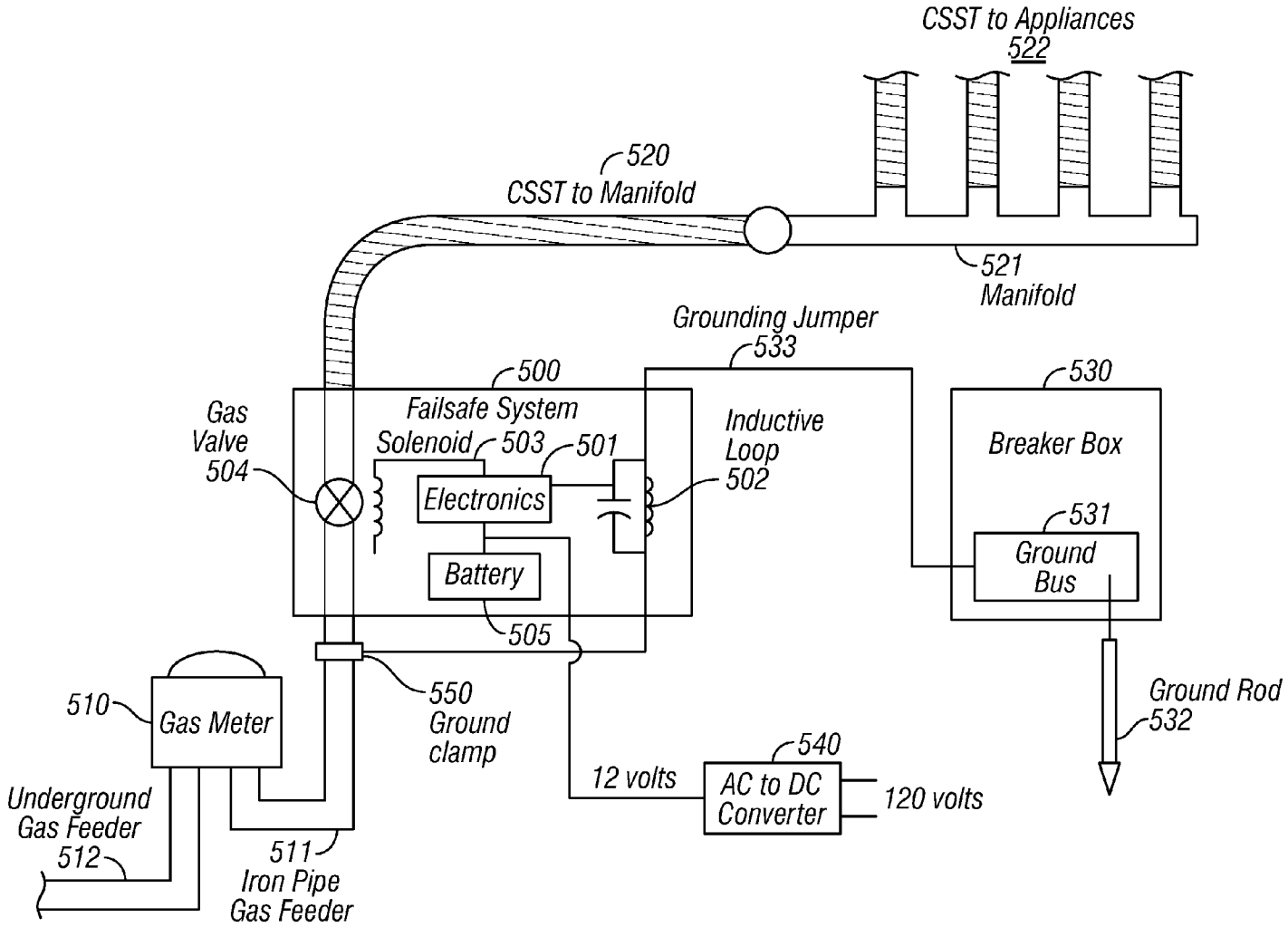
FIG. 5 shows an embodiment of an electrical failsafe system in accordance with a preferred embodiment of the present invention.

FIG. 5 shows an electrical failsafe system in accordance with a preferred embodiment of the present invention. The failsafe system 500 of the present invention is positioned between the gas feeder line 511 and the CSST 520 that is coupled to the manifold 521 that distributes gas to appliances through additional CSST lines 522.

CSST is installed such that it is electrically referenced to ground, either by a grounding jumper attached at the gas manifold or to the incoming gas line to the building. In the present example, the grounding jumper 533 is coupled via ground clamp 550 to the incoming gas line 511 that feeds gas from the underground feeder 512. The grounding jumper 533 is coupled to a ground bus 531 that provides the ground path for the breaker box 530 through ground rod 532. Should lightning strike the CSST piping 520, 522, either directly or indirectly through arcing from an adjacent structure, a portion of the charge will be diverted to the grounding jumper 533.

The present invention uses a tuned circuit that is inductively coupled to the ground conductor 533 by way of an inductive loop 502. The loop is encased in an insulating resin so as to both weatherproof it and to serve as an electrical isolator. The inductive loop then is shunted by transient protection, to include a Metal Oxide Varistor (MOV) (not shown).

The output of the loop is fed to control circuitry 501 than includes a tuned amplifier that is centered at about 300 KHz. When lightning currents flow down the ground path, the inductive loop 502 senses the current, and the resultant signal is amplified by the amplifier. The output of the control circuitry 501 is used to control the flow of a gas valve 504 that has an electrical solenoid 503 as its actuating means. In use, the solenoid 503 is held open by continuous electrical current supplied by the control circuitry 501. In response to a lightning pulse, the current is removed and the magnetic field from the solenoid 503 ceases to exist, thereby causing the gas valve 504 to close and shut off the gas flow through the CSST.

The electrical current for the control circuitry and solenoid are derived from a 120 VAC stepdown transformer 540 with DC rectification and filtering. This power supply also keeps a backup battery 505 charged, such that the control circuitry 501 and gas valve 504 can still function in the event of a power outage.

In an alternate embodiment of the invention, multiple sensors can be used instead of a single tuned circuit like the one shown in FIG. 5. The use of multiple sensors provides backup capabilities especially in the case of lightning strikes, which are devastating in the degree of electrical insult they produce.

Additionally, if the intensity of a lightning strike is strong enough to destroy semiconductor junctions in the circuitry, the circuitry will cease to function properly, thereby failing in a safe manner and removing current to the solenoid. This will cause the gas valve to close, thereby avoid gas leakage through any perforations in the CSST that may have resulted from the electrical insult.

Figure 6:
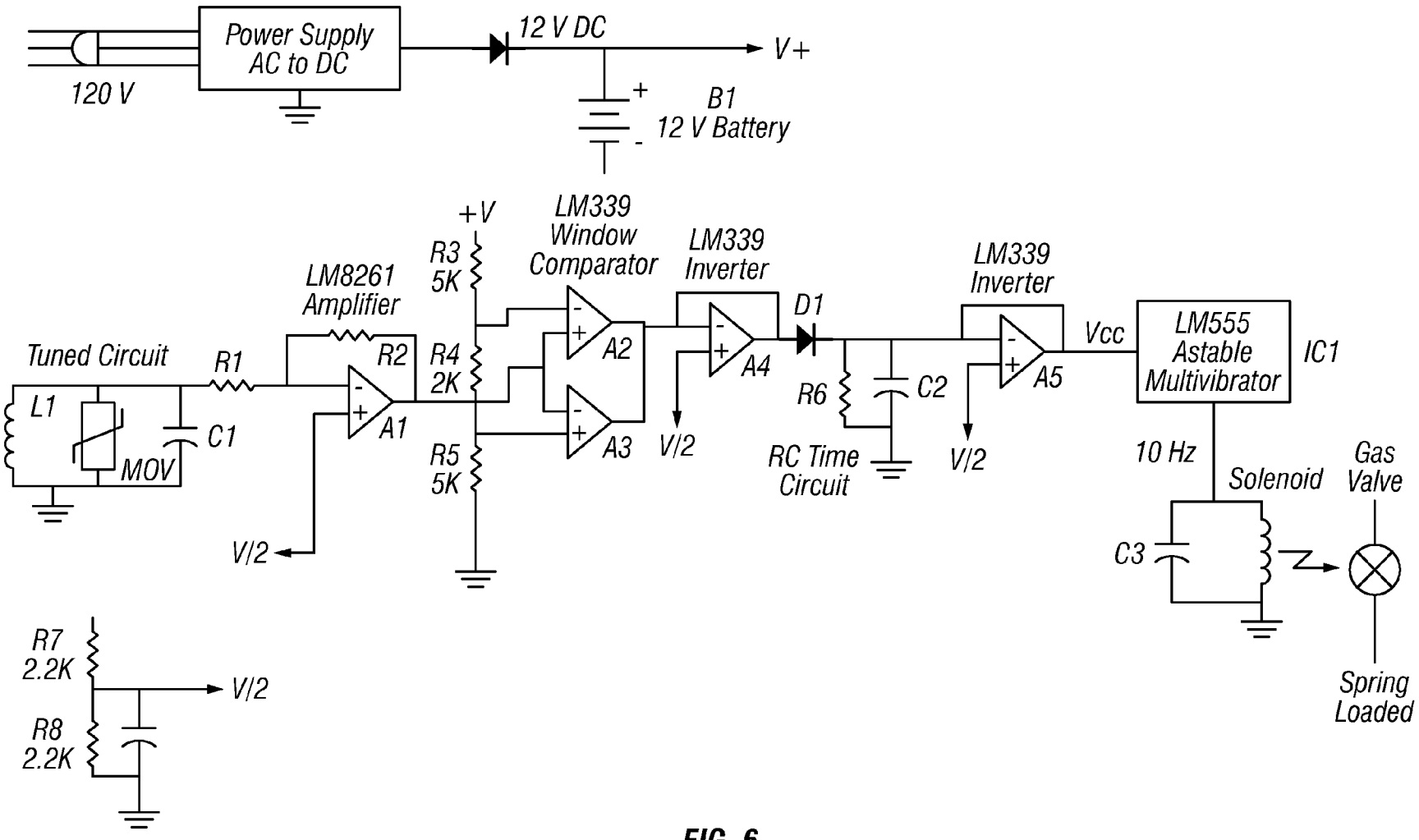
FIG. 6 is a detailed circuit diagram of the embodiment of the electrical failsafe system shown in FIG. 5 in accordance with the present invention.

FIG. 6 is a detailed circuit diagram of the electrical failsafe system 500 in accordance with the present invention. Referring to the left side of the diagram, L1 and C1 form a tuned circuit that is at resonance at approximately 300 KHz. L1 is an inductive loop that is placed around the ground conductor in a house, preferably the conductor that is used to bond the gas manifold for the CSST to the electrical system. The MOV (Metal Oxide Varistor) is used to protect the input of the amplifier A1 from high voltage transients.

A1 is a fast operational amplifier such as, e.g., a LM8261 or LM318 produced by National Semiconductor. Resistors R1 and R2 are chosen to give amplifier a gain of −10. The amplifier A1 output is coupled to a window comparator consisting of resistors R3, R4, and R5, as well as amplifiers A2 and A3. The values of R3 and R5 are set at about 5 K ohms, and the value of R4 is set at about 2 K ohms. In the preferred embodiment the integrated circuits (IC) for amplifiers A2, A3, A4 and A5 are LM339s.

Under normal electrical conditions (i.e., when no lightning is detected) the output of A1 is about Vcc/2 (half positive supply voltage), or 6 volts, and the window comparator is set to have a window of about 5 to 7 volts. When the 6 volt signal from the A1 is fed to the window comparator, the output of the window comparator is Vcc, or 12 volts.

When lightning sends a pulse down the ground line, the pulse has a fast wave front that is sensed by the inductor/tuned circuit. This drives the amplifier A1 to either zero volts (ground) or 12 volts (Vcc), depending upon the polarity of the pulse.

The window comparator has an output signal that approaches either zero volts/negative rail (low) or 12 volts/positive rail (high). A 12 volt or zero volt signal from amplifier A1 to the window comparator causes the window comparator to have a low signal on its output. The timing of this low signal output will usually be a several-microsecond wide pulse, typically 3-4 μs.

The pulse from the window comparator is inverted by A4 and is fed to a resistor-capacitor (RC) time constant circuit comprising R6 and C2. In a preferred embodiment, this RC circuit is set at about one second. When powered by the window comparator output, the RC circuit (R6, C2) is driven to about 12 volts (Vcc), and then slowly discharges. The diode D1 insures that the low impedance output of the window comparator (A2, A3) does not affect the discharge rate of the time constant circuit R6, C2.

The inverted pulse (now stretched by the RC network) is then inverted again by inverter A5. The second inverter A5 is set at about Vcc/2, or 6 volts. Under normal conditions (no lightning), inverter A5 has a high output signal approaching 12 volts that provides power to IC1, which in the preferred embodiment is a National Semiconductor LM555 multivibrator timer set to operate in an astable mode at 10 Hz.

A continuous pulse train from the multivibrator maintains a charge on capacitor C3, which is in parallel with a solenoid that forms part of the gas valve. The RC circuit formed by the impedance of the solenoid and the capacitor C3 keep the solenoid closed, which maintains the gas valve in an open, continuous flow mode.

When lightning is detected, the several-microsecond pulse width of the low signal from the window comparator is stretched by the RC time constant circuit (R6, C2) to about 1 second, thereby removing power to the IC1 mulitvibrator. The loss of power to IC1 stops the pulse train to C3 and the solenoid. Without the pulse train from the multivibrator, energy stored in the capacitor C3 is quickly dissipated, and the solenoid voltage drops (decays), allowing a spring within the solenoid to overcome the depleting magnetic forces and shut the gas valve. The gas valve must then be manually reset before gas flow can resume.

Referring to the top of the FIG. 5, a battery B1 is used to maintain gas flow within the system in the event of a power outage. A power supply module converts nominal house voltage (120 V 60~) to 12 volt nominal DC. The AC to DC converter (power supply) isolates the action of the gas valve by virtue of the insulation/isolation of the converter. In a preferred embodiment, the power supply is kept in a separate housing (such as plugs in a wall). This is done to try and keep the circuitry isolated from voltage spikes that may also be on the power line.

Referring to the lower left of FIG. 5, a pair of resistors R7 and R8 form a voltage divider to supply a V/2 reference for A1, A4 and A5.

The present invention is not limited to use with lightning strikes and can be adapted for use with electrical insults resulting for more mundane causes such as appliance shorts. Many fires are also caused when normal 60 Hz energy is inadvertently placed on Gas Appliance Connectors (GAC). Specifically, the electrical current damages the flared ends of these gas connectors, resulting in fire. The danger of 60 Hz ground faults to GACs and the propensity of these ground faults to cause fires is outlined in the paper "*Electrically Induces Gas Fires", Fire and Arson Investigator*, July 1999.

Figure 7:
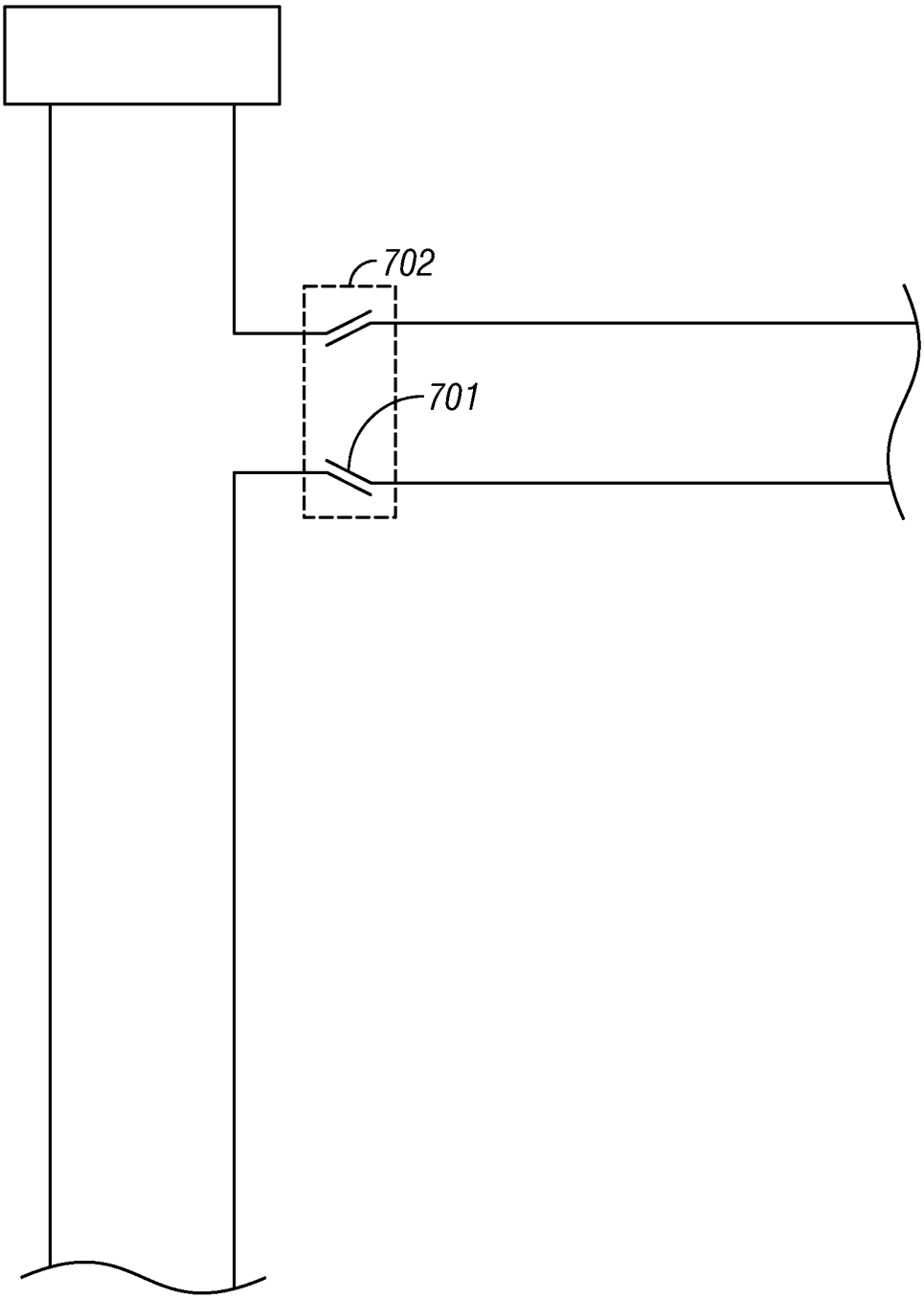
FIG. 7 shows a cross section view illustrating the physical interface between a Gas Appliance Connector and gas pipe.

FIG. 7 shows a cross section view illustrating the physical interface between a GAC and gas pipe. Flexible appliance connectors, as recognized by the Fuel Gas Code and other codes, make use of flared connections at their ends 701, along with the usual nut 702 (often brass) to make the connection secure. One means of failure of these types of connections is brought about when current from electric discharges is sent down the appliance connector in an attempt to reach ground potential. While the flared connections 701 are sufficient in terms of their ability to carry gas from a mechanical connection, the flared connection is subject to failure when required to carry electric current. The electric current often causes the flared connection to melt and arc, resulting in a gas leak and igniting the gas.

As with insult from lightning, currents will flow down the ground path. The signal can be inductively coupled, with 60 Hz being the frequency of interest. In this embodiment, the tuned circuit/amplifier will respond to ground currents in the 60 Hz region, corresponding to some type of ground fault. Alternatively, the signal can be directly coupled by a differential amplifier which derives its signal from the voltage drop along the ground wire. In either case, the 60 Hz ground fault will be sensed and the gas flow stopped in the manner describe above.

The circuit of the present invention can also be modified such that the front end tuned circuit is replaced by a Hall effect magnetic sensor, or by a direct contact means.

Figure 8:
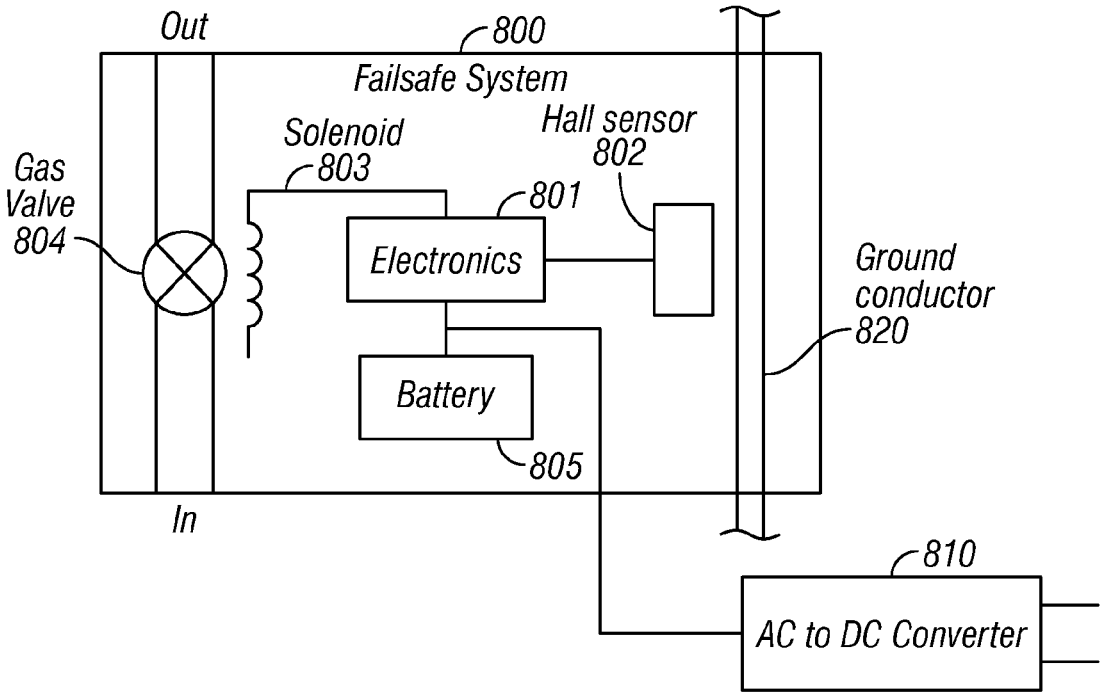
FIG. 8 shows an alternate embodiment of the present invention incorporating a Hall effect sensor.

FIG. 8 shows an alternate embodiment of the present invention incorporating a Hall effect sensor 802.

Figure 9:
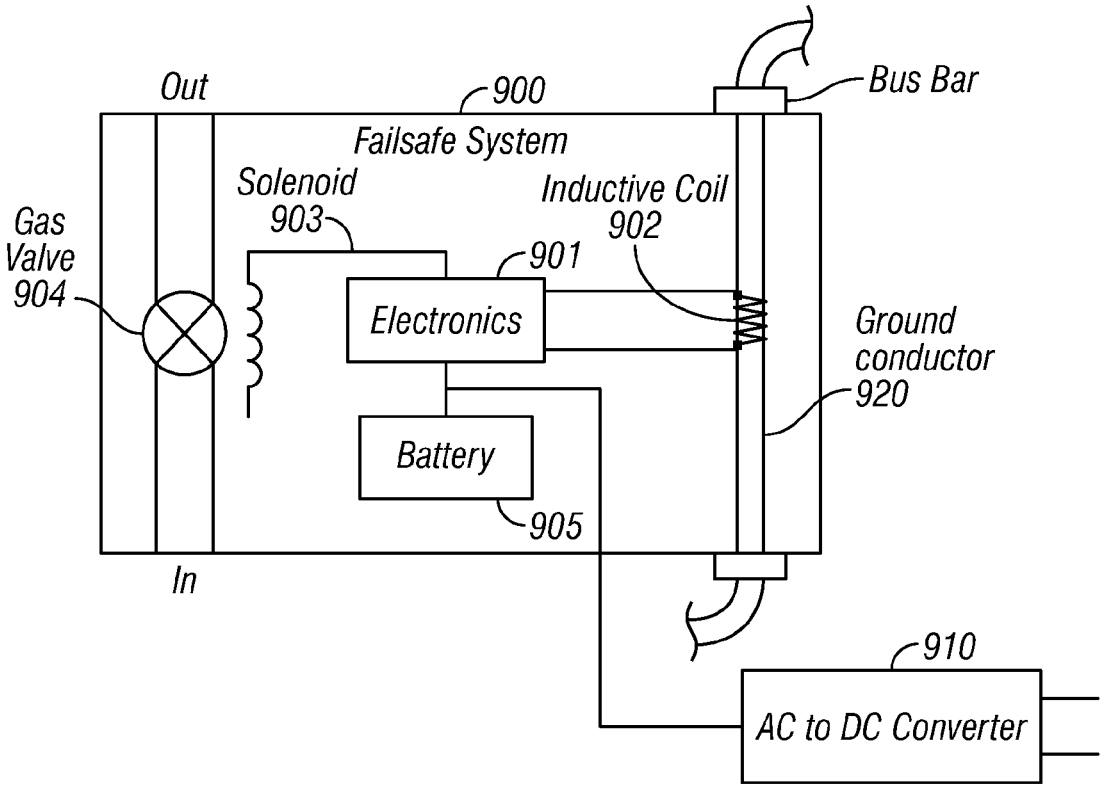
FIG. 9 shows an alternate embodiment of the present invention incorporating a direct contact inductive coil.

FIG. 9 shows an alternate embodiment of the present invention incorporating a direct contact inductive coil 902. In this design, the current flow from lightning creates voltage drop along the ground conductor 920. This current flow is sensed by a differential amplifier which has two inputs taken several inches apart on the ground wire 920 (usually #6 or greater copper). When a large current is present, as in the case of lightning or a 60 Hz ground fault, the voltage drop will be sensed and the remainder of the circuit 901, beginning at the window comparator, will accordingly stop the gas flow.

As stated briefly above, multiple sensors may be used to detect electrical surges along the ground conductor. These multiple sensors may be of a single type or different types. Therefore, the failsafe system of the present invention may use multiple tuned circuits, Hall effect sensors, or direct contact coils, or any combination thereof.

Alternate embodiments of the automated gas cut-off system of present invention may include multiple energy detection schemes to detect electrical energy surges on the gas line. In addition, alternative embodiments may further include a residual gas dispersal system that vents the residual downstream gas pressure by opening a secondary valve releasing residual pressurized gas to atmospheric air.

Figure 10A:
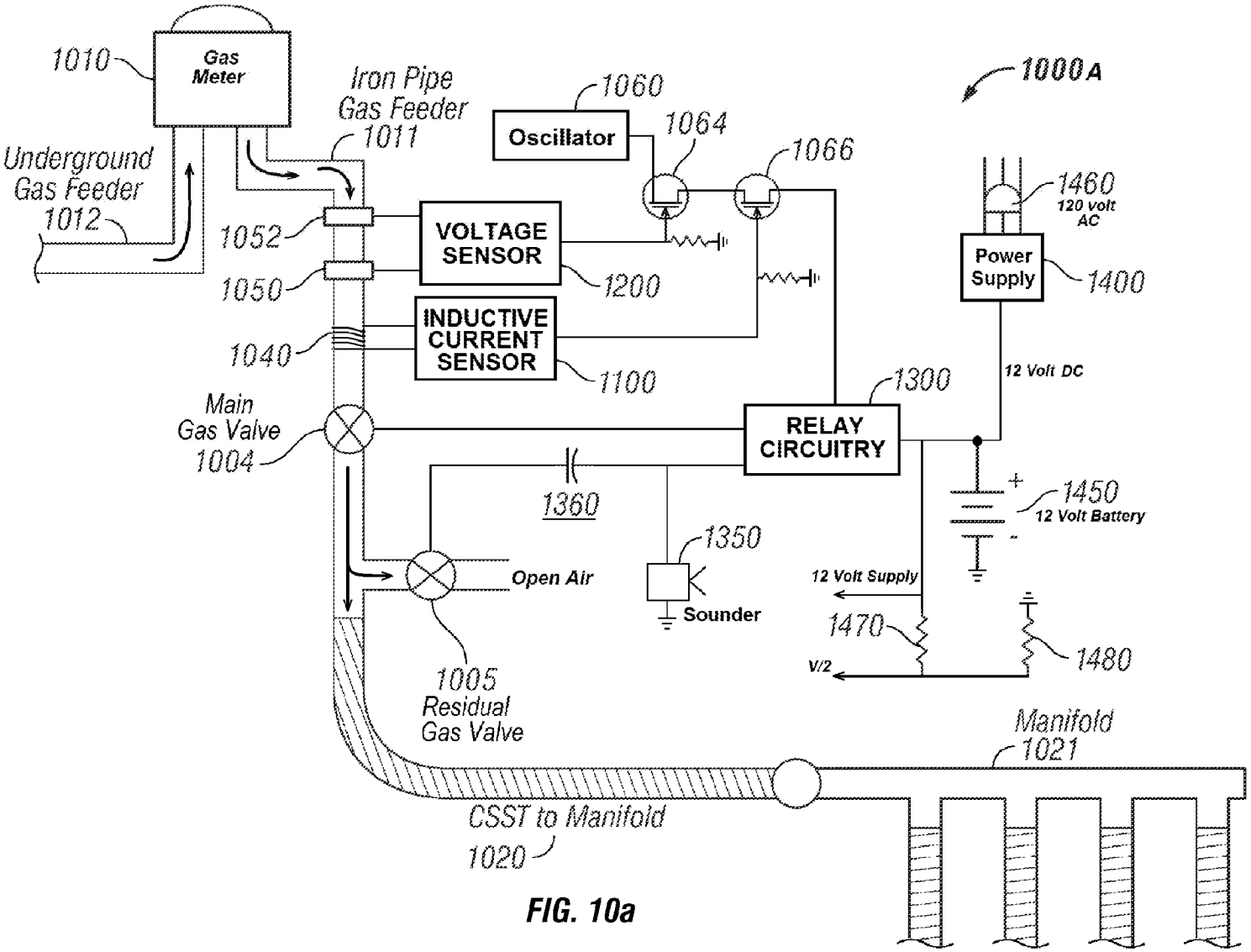
FIG. 10*a* shows a first enhanced alternate embodiment of an electrical failsafe system of the present invention incorporating a residual gas dispersal system.

For example, as shown in FIG. 10*a*, a first enhanced alternate embodiment of the present invention 1000A is depicted. The enhanced system 1000A may include multiple energy detection systems to detect electrical energy surges on the gas line. The energy detection systems detect whether electrical energy in the form of lightning currents or 60 Hz energy, is flowing along the gas piping system. In a preferred embodiment, the energy detection systems include an inductive current sensor system 1100 and a voltage sensor system 1200. The multiple energy detection systems are positioned between the gas feeder line 1011 and the CSST 1020 that is coupled to the manifold 1021 that distributes gas to appliances through additional CSST lines. The multiple energy detection systems 1100, 1200 are each designed to sense electrical current along the gas feeder line 1011. If either the current sensor system 1100 or the voltage sensor system 1200 detects an electrical current indicative of an electrical insult to the gas supply system, the enhanced system cuts the gas flow off by deactivating a solenoid in the main gas valve 1004. The system removes the supply of electrical current to the main gas valve 1004 causing the magnetic field from the solenoid 1004*a* to cease to exist, thereby causing the gas valve 1004 to close and shut off the gas flow through the CSST. The system of the present invention is designed to continually function by internally changing logic states. Any cessation of these changing states, such as component failure, causes the system to halt the gas flow.

The electrical current for the control circuitry and solenoids are derived from a 120 VAC stepdown transformer power supply 1400 with DC rectification and filtering. The power supply 1400 supplies a nominal 12 volts DC to the system. The power supply 1400 also keeps a backup battery 1450 charged, such that the control circuitry and gas valves can still function in the event of a power outage. In a preferred embodiment, the backup battery 1450 consists of a gel cell that is kept trickle charged by supply 1400. Resistors 1470 and 1480 form a voltage divider, bringing V/2 (about 6 volts) to use as reference inputs on the various differential amplifiers (op amps). A line cord 1460 may be used to bring AC power to the power supply.

The system of the invention 1000A perceives such electrical surges by detecting a voltage drop created in the gas line and/or a magnetic field induced in the gas line. When an energy surge is detected a latching relay system cuts off power to the main gas valve 1004. The latching relay system monitors a continuous AC pulse train generated by an onboard oscillator 1060. Detection of the energized gas line causes the AC pulse train to be blocked from the latching relay. The latching relay system, by monitoring the AC pulse train as opposed to a DC level, insures that a damaged component, such as a shorted or open transistor, will cause the unit to fail in a safe mode by removing power from the main gas valve 1004.

However, residual gas pressure remains in the gas piping system downstream from the main gas valve 1004. If the electrical insult has caused a small pinhole orifice in the downstream CSST piping system, there exists the possibility of a fire occurring from gas leaking out of the newly created orifice. Thus, to further enhance the safety of the system, a secondary bleed-off valve 1005 is opened momentarily venting the residual internal pressure of the gas system to the open atmosphere. The gas bleed-off valve 1005 has in series with its solenoid coil 1005*a* a DC blocking capacitor 1360. This capacitor 1360, along with the resistance and inductance of the solenoid 1005*a*, form a RC time constant, allowing the valve 1005 to open for only several seconds, at most. This DC blocking feature helps insure that the residual gas bleed-off valve 1005 is open for only several seconds, at most, both to conserve energy (i.e., minimize lost fuel gas) and minimize the fire or explosion hazard. The output or exhaust of the gas bleed-off valve 1005 is plumbed by the installer so that the residual gas is vented to the exterior open air, and not internally inside a building. The reduction in pressure caused by this momentary venting helps to further insure that any flame generated at the electrically induced orifice is short-lived in duration.

Figure 11:
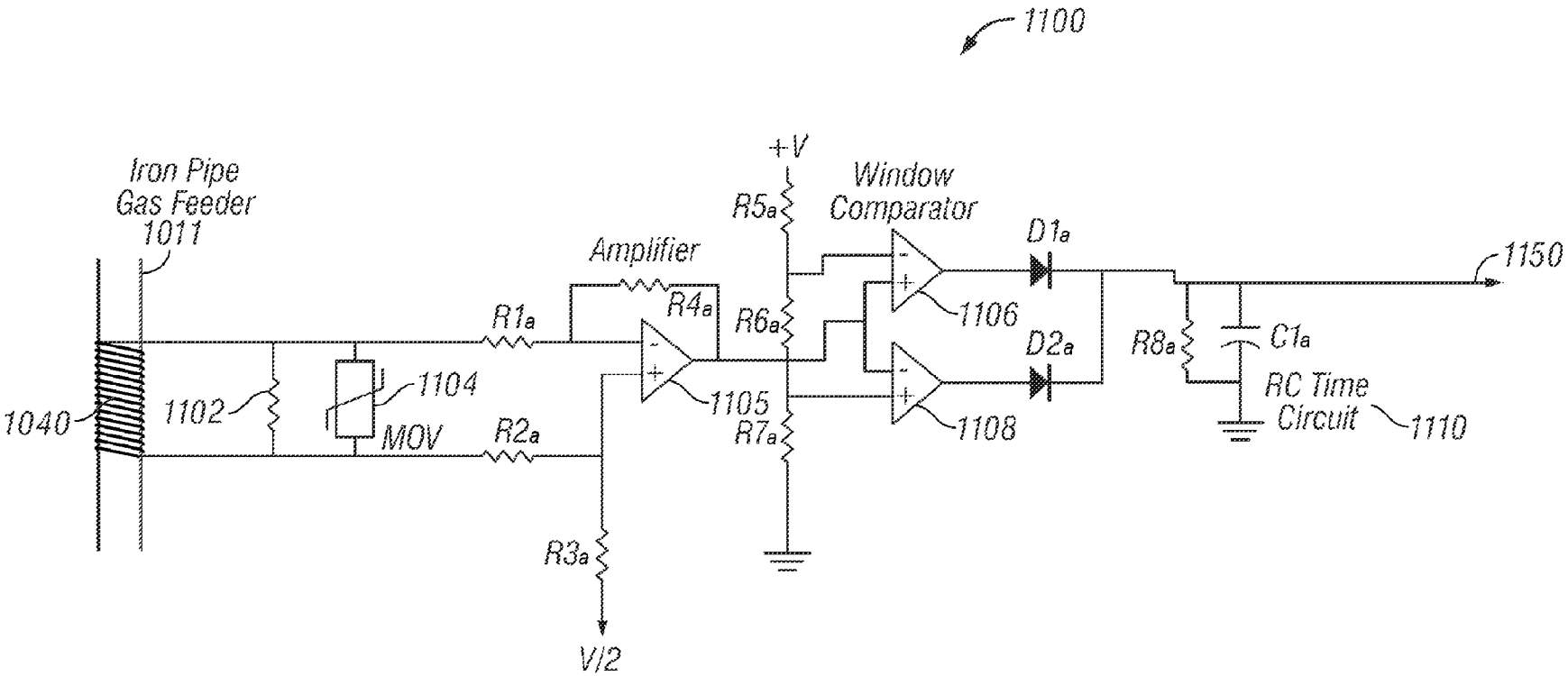
FIG. 11 is a detailed circuit diagram of an embodiment of the voltage sensor in the embodiments of the electrical failsafe systems shown in FIGS. 10*a* and *b* in accordance with the present invention.

With reference again to Figures, and in particular FIGS. 10*a* and 11, the system 1000A includes an inductive current sensor system 1100 that includes an inductive coil 1040 wrapped around a rigid gas feeder pipe or nipple 1011, which is commonly constructed of rigid iron pipe. The rigid gas feeder pipe or nipple 1011 is fluidly connected to a main or feeding gas valve 1004. Gas valve 1004 is controlled or actuated by an electrical solenoid. When the electrical solenoid is not energized, the gas valve 1004 remains closed due to the effects of a biasing spring. However, when the electrical solenoid 1004*a* is energized, the gas valve 1004 opens. This, in turn, allows gas to flow from the inlet nipple 1011, through the gas valve 1004 to the CSST that is coupled to the manifold 1021 wherein the in-coming gas is routed through a distribution system that includes both the CSST and GAC portions.

With reference to FIG. 11, the inductive current sensor system 1100 monitors electrical current along the gas feed pipe 1011. When inductive coil 1040 senses electrical current along the nipple 1011, a resultant inductive current is induced in the coil 1040. The resulting voltage appears across resistor 1102. A differential amplifier 1105 is a fast operational amplifier that amplifies the signal that is produced across the resistor 1102. A surge suppressor 1104 is a MOV that is used to limit or clip the incoming inductively produced signal. The MOV 1104 is used to protect the input of the amplifier 1105 from high voltage transients.

The output of the differential amplifier 1105 is normally at about ½ the supply voltage, or 6 volts. Depending on the polarity of the current flow through the nipple 1011, the output of the differential amplifier 1105 will either swing towards the positive supply rail or the negative supply rail. The output of the differential amplifier 1105 is fed to a window comparator, made from the differential amplifiers 1106 and 1108. Level setting resistors R5*a*, R6*a*, and R7*a* are used such that a window is created from about 5.5 to 6.5 volts. Should the output of the differential amplifier 1105 exceed 6.5 volts, or fall below 5.5 volts, this is an indicator that current is flowing in the gas piping system. The outputs of the window comparator op amps 1106 and 1108 are OR'd together using two diodes, D1*a* and D2*a*. ARC network 1110 (i.e., R8*a*, C1*a*) is used to set an RC time constant of about 0.5 seconds on the output of the OR gate D1*a* and D2*a*. The output of the OR gate, in addition to feeding the RC network 1110, is also used to control the gas valve, as will be discussed later.

Figure 12:
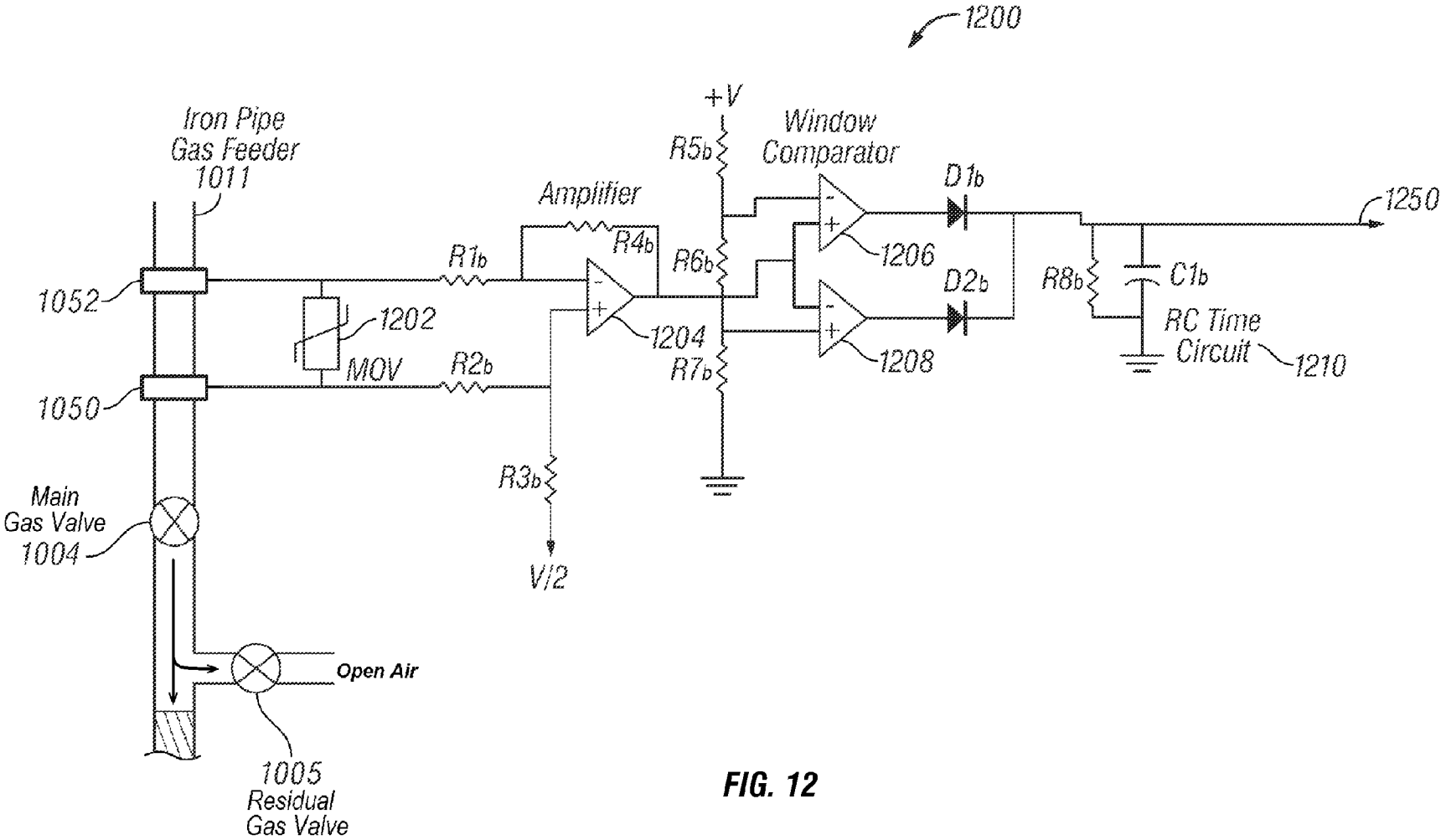
FIG. 12 is a detailed circuit diagram of an embodiment of the inductive sensor in the embodiments of the electrical failsafe systems shown in FIGS. 10*a* and *b* in accordance with the present invention.

With reference to FIG. 12, a second means for sensing current flow on the gas feed pipe 1011 is demonstrated by measuring the actual voltage drop across the black pipe. Two ground type clamps 1050, 1052 are secured to the nipple 1011, several inches apart. Current flow of several amps or more will introduce a voltage drop between the two clamps 1050 and 1052. The differential voltage is then fed to amplifier (op amp) 1204, which is used in a differential form. The output of the op amp 1204, when no current is flowing through the gas feed pipe 1011, should be about V/2, or 6 volts. When current flow of several amps or more is present on the nipple 1011, the op amp 1204 will have an output that will swing positive or negative. Should the output voltage exceed 6.5 volts or fall below 5.5 volts, a window comparator (op amps 1206 and 1208) will sense the voltage and respond by swinging high. The two outputs of the window comparator are then OR'd together by diodes D1*b* and D2*b*. This OR'd output is then fed to a RC network 1210 (i.e., R8*b*, C1*b*) with a time constant of about 0.5 seconds. MOV 1202 provides surge suppression for the input of the op amp 1204. Resistors R5*b*, R6*b*, and R7*b* form a voltage divider network that set the limit windows of the window comparator to about 5.5 and 6.5 volts. The RC network 1210 consists of the paralleled capacitor C1*b* and resistor R8*b*.

The invention so far has used an inductive coupling scheme for sensing current along a gas pipe, as well as a direct voltage measuring scheme. Each of these separate sensing systems generate what is essentially an analog "1" condition if electrical current is detected on the gas feeder pipe 1011 by way of inductive coupling or by resistive voltage drop.

Figure 13A:
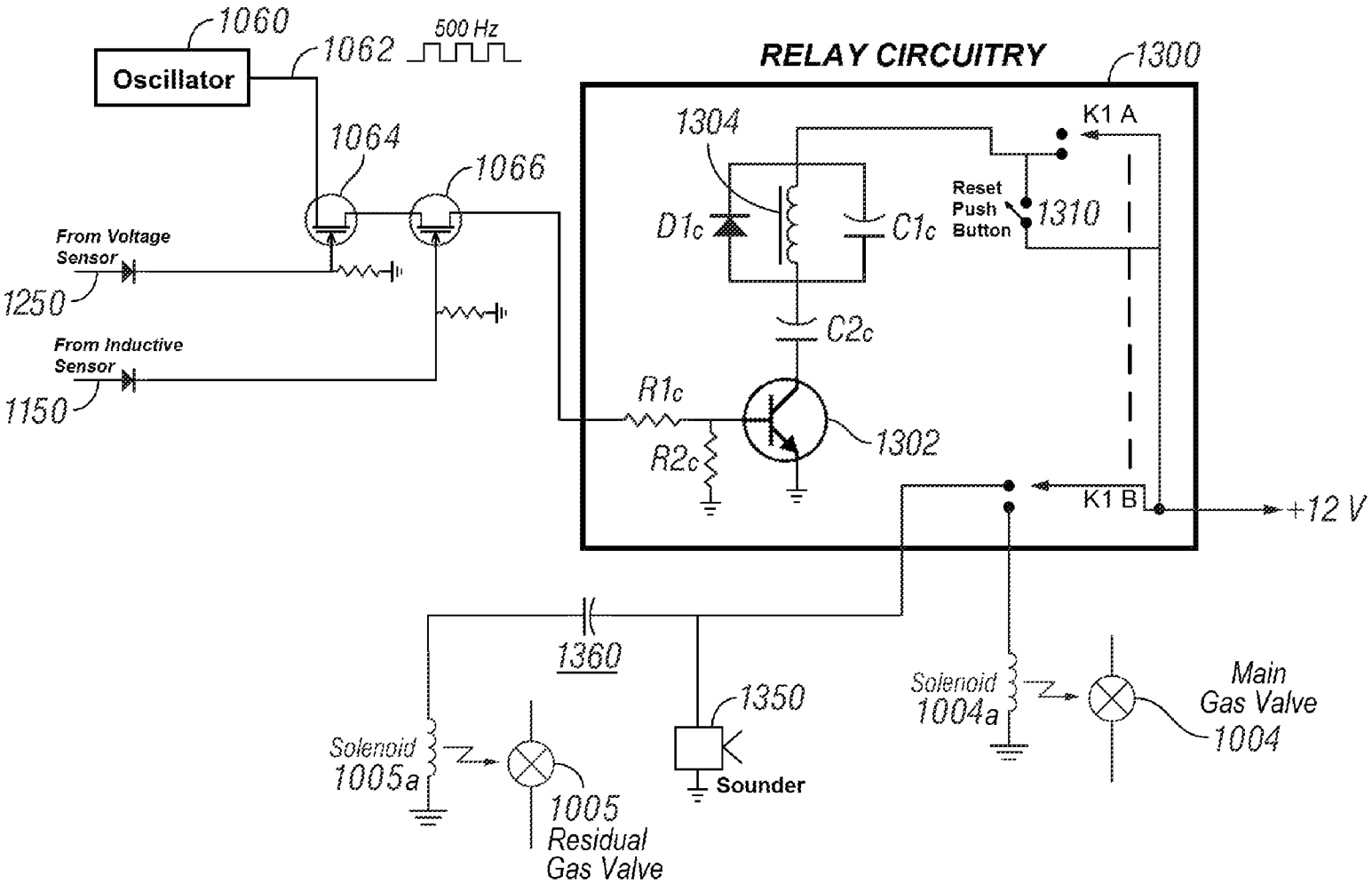
FIG. 13*a* is a detailed circuit diagram of an embodiment of the relay circuitry in the embodiment of the electrical failsafe system shown in FIG. 10*a* in accordance with the present invention.

With reference to FIG. 13*a*, should either the inductive coupling 1100 or the resistance 1200 method detect a signal on the gas feeder pipe 1011, corresponding to current flow along the gas feeder pipe 1011, then the desired response is for the system to cut the gas flow off. Gas flow of the system is maintained by valve 1004 and its solenoid 1004*a*. In order to allow gas flow, a pulse train of square waves is produced by a 555 timer/oscillator denoted as 1060. The output 1062 of timer/oscillator 1060, a continual pulse train, is gated to a transistor base (transistor 1302) by two FETs, 1064 and 1066. The FETs 1064 and 1066 are used in an analog switch mode. The gate voltage is controlled by the respective outputs 1150, 1250 from the induction coupling system 1100 and the voltage drop detection system 1200. So long as no substantive current is flowing on the gas piping system, both FETS 1064 and 1066 will be shorts, and will conduct the square wave from 555 timer 1060 to the base of the drive transistor 1302 in the relay circuitry 1300.

Transistor 1302, driven by the pulse train, is a common emitter drive transistor, used to energize the coil of relay 1304. The circuit for the coil on relay 1304 has in parallel with it a free wheeling diode D1*c* and an electrolytic capacitor C1*c*. In addition, the coil for relay 1340 has in series with it a large blocking capacitor C2*c*.

The blocking capacitor C2*c* insures that damage to transistor 1302 (e.g., in the form of a short) will cause the coil of relay 1304 to lose current by the capacitor's blocking action. Likewise, electrical damage to the timer circuit (timer 1060) will cause square wave generation to cease. When this occurs, the current in the coil of relay 1304 ceases, causing the relay contacts on relay 1304 to open. When the relay contacts on relay 1304 open power is removed from the main gas valve 1004, causing gas flow to downstream appliances to cease. One set of the contacts on relay 1304 act as a latch, insuring that power to the main gas valve 1004 is not restored without manual intervention, i.e., pushing the reset push-button 1310. Twelve volt power is fed to the residual gas valve 1005, causing the residual gas valve 1005 to open momentarily.

The purpose of the residual gas valve 1005 is to relieve the residual internal pressure of the gas piping system downstream from the main gas valve 1004. In the event of an electrical lightning discharge, the main gas valve 1004 closes. However, the downstream gas piping system and appliances are still under residual pressure. In the event that lightning has created a hole in the CSST or GAC, the pressurized gas will escape under pressure from that hole. By opening the residual gas valve 1005 and venting the gas pressure to the atmosphere, the release of pressurized gas at the newly created hole is minimized. A blocking capacitor 1360 insures that the gas valve 1004 will only be open for about a half of a second. As the RC circuit created by the solenoid 1004*a* on the main gas valve 1004 and DC blocking capacitor 1360 charge up, current flow decreases exponentially. The blocking capacitor 1360 insures that should relay 1304 malfunction, or if a lightning condition is detected, there is not unabated free flow of gas to the atmosphere.

The system may also include a push-button to manually reset the system in case electrical energy energizes the gas line resulting in the gas flow being shut off. The push-button 1310 is a momentary push-button used to restore power to the coil of the latching relay 1304 after the unit has detected electrical current and opened up.

The system may also include an audible alarm to alert the user of gas interruption by use of an audible sounding device. In a preferred embodiment, the audible sounding device comprises a buzzer mechanism or sounder 1350 to alert the user that the system has actuated. In that it is not in series with blocking capacitor 1360, the sounder 1350 will sound continuously.

Figure 10B:
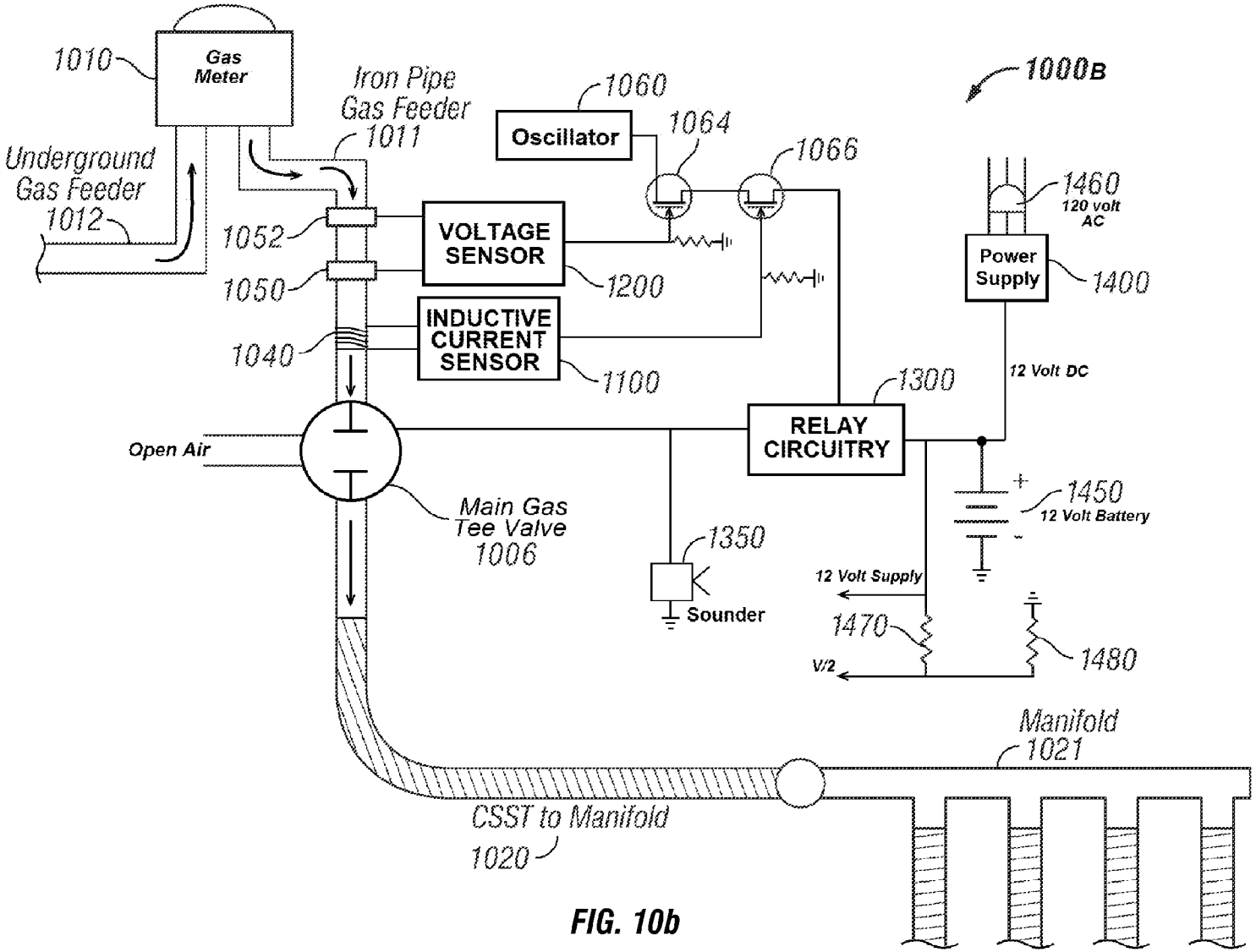
FIG. 10*b* shows a second enhanced alternate embodiment of an electrical failsafe system of the present invention incorporating a residual gas dispersal system that features a tee valve.

With reference now to FIG. 10*b*, a second enhanced alternate embodiment of the present invention 1000B is depicted. As with the previous embodiment, the enhanced system 1000B may include multiple energy detection systems to detect electrical energy surges on the gas line. The energy detection systems detect whether electrical energy in the form of lightning currents or 60 Hz energy, is flowing along the gas piping system. As with the previous embodiment, in a preferred embodiment, the energy detection systems include an inductive current sensor system 1100 and a voltage sensor system 1200. The multiple energy detection systems are positioned between the gas feeder line 1011 and the CSST 1020 that is coupled to the manifold 1021 that distributes gas to appliances through additional CSST lines. The multiple energy detection systems 1100, 1200 are each designed to sense electrical current along the gas feeder line 1011. If either the current sensor system 1100 or the voltage sensor system 1200 detects an electrical current indicative of an electrical insult to the gas supply system, the enhanced system cuts the gas flow off by deactivating a solenoid in the main gas tee (i.e., two-way) valve 1006. The system removes the supply of electrical current to the main gas tee valve 1006 causing the magnetic field from the solenoid 1006*a* to cease to exist, thereby causing the main gas tee valve 1006 to close and shut off the gas flow through the CSST 1020, while allowing residual downstream gas pressure to be dumped to open air. The system of the present invention 1000B is designed to continually function by internally changing logic states. Any cessation of these changing states, such as component failure, causes the system to halt the gas flow.

The electrical current for the control circuitry and the solenoid for the main gas tee valve 1006 are derived from a 120 VAC stepdown transformer power supply 1400 with DC rectification and filtering. The power supply 1400 supplies a nominal 12 volts DC to the system. The power supply 1400 also keeps a backup battery 1450 charged, such that the control circuitry and gas valves can still function in the event of a power outage. In a preferred embodiment, the backup battery 1450 consists of a gel cell that is kept trickle charged by supply 1400. Resistors 1470 and 1480 form a voltage divider, bringing V/2 (about 6 volts) to use as reference inputs on the various differential amplifiers (op amps). A line cord 1460 may be used to bring AC power to the power supply.

The system of the invention 1000B perceives such electrical surges by detecting a voltage drop created in the gas line and/or a magnetic field induced in the gas line. When an energy surge is detected a latching relay system cuts off power to the main gas valve 1006. The latching relay system monitors a continuous AC pulse train generated by an onboard oscillator 1060. Detection of the energized gas line causes the AC pulse train to be blocked from the latching relay. The latching relay system, by monitoring the AC pulse train as opposed to a DC level, insures that a damaged component, such as a shorted or open transistor, will cause the unit to fail in a safe mode by removing power from the main gas tee valve 1006.

However, residual gas pressure remains in the gas piping system downstream from the two-way main gas tee valve 1006. If the electrical insult has caused a small pinhole orifice in the downstream CSST piping system 1020, there exists the possibility of a fire occurring from gas leaking out of the newly created orifice. Thus, to further enhance the safety of the system 10008, the main gas tee valve 1006, which (in the second configured position) blocks gas flow to the CSST piping system 1020 and manifold 1021, also vents the CSST piping system 1020 and manifold 1021 to open air; thus bleeding off pressure in the otherwise charged gas line. The output or exhaust of the gas bleed-off portion of main gas tee valve 1006 is plumbed by the installer so that the residual gas is vented to the exterior open air, and not internally inside a building. The reduction in pressure caused by this venting helps to further insure that any flame generated at the electrically induced orifice in the gas piping is short-lived in duration.

With reference again to Figures, and in particular FIGS. 10*b*, 11 and 12, the system 1000B includes a detection system that is essentially identical to the previously disclosed system 1000A. Thus, the system 1000B includes an inductive current sensor system 1100, which includes an inductive coil 1040 wrapped around a rigid gas feeder pipe or nipple 1011, which is commonly constructed of rigid iron pipe. The rigid gas feeder pipe or nipple 1011 is fluidly connected to a main or feeding gas tee valve 1006. The main gas tee valve 1006 is controlled and actuated by an electrical solenoid 1006*a*. When the electrical solenoid 1006*a* is not energized, the gas valve 1006 reverts to a second or closed position due to the effects of a biasing mechanism (e.g., spring) configured within the valve. However, when the electrical solenoid 1006*a* is energized, the main gas tee valve 1006 is configured in a first or opened position. This, in turn, allows gas to flow from the inlet nipple 1011, through the main gas tee valve 1006 to the CSST piping system 1020 that is coupled to a manifold 1021, which routes the in-coming gas through a distribution system that may include both CSST and GAC portions.

With reference to FIG. 11, the inductive current sensor system 1100 monitors electrical current along the gas feed pipe 1011. When inductive coil 1040 senses electrical current along the nipple 1011, a resultant inductive current is induced in the coil 1040. The resulting voltage appears across resistor 1102. A differential amplifier 1105 is a fast operational amplifier that amplifies the signal that is produced across the resistor 1102. A surge suppressor 1104 is a MOV that is used to limit or clip the incoming inductively produced signal. The MOV 1104 is used to protect the input of the amplifier 1105 from high voltage transients.

The output of the differential amplifier 1105 is normally at about ½ the supply voltage, or 6 volts. Depending on the polarity of the current flow through the nipple 1011, the output of the differential amplifier 1105 will either swing towards the positive supply rail or the negative supply rail. The output of the differential amplifier 1105 is fed to a window comparator, made from the differential amplifiers 1106 and 1108. Level setting resistors R5*a*, R6*a*, and R7*a* are used such that a window is created from about 5.5 to 6.5 volts. Should the output of the differential amplifier 1105 exceed 6.5 volts, or fall below 5.5 volts, this is an indicator that current is flowing in the gas piping system. The outputs of the window comparator op amps 1106 and 1108 are OR'd together using two diodes, D1*a* and D2*a*. ARC network 1110 (i.e., R8*a*, C1*a*) is used to set an RC time constant of about 0.5 seconds on the output of the OR gate D1*a* and D2*a*. The output of the OR gate, in addition to feeding the RC network 1110, is also used to control the gas valve, as will be discussed later.

With reference to FIG. 12, the system 1000B may also include the second means for sensing current flow on the gas feed pipe 1011 by measuring the actual voltage drop across the black pipe. Two ground type clamps 1050, 1052 are secured to the nipple 1011, several inches apart. Current flow of several amps or more will introduce a voltage drop between the two clamps 1050 and 1052. The differential voltage is then fed to amplifier (op amp) 1204, which is used in a differential form. The output of the op amp 1204, when no current is flowing through the gas feed pipe 1011, should be about V/2, or 6 volts. When current flow of several amps or more is present on the nipple 1011, the op amp 1204 will have an output that will swing positive or negative. Should the output voltage exceed 6.5 volts or fall below 5.5 volts, a window comparator (op amps 1206 and 1208) will sense the voltage and respond by swinging high. The two outputs of the window comparator are then OR'd together by diodes D1*b* and D2*b*. This OR'd output is then fed to a RC network 1210 (i.e., R8*b*, C1*b*) with a time constant of about 0.5 seconds. MOV 1202 provides surge suppression for the input of the op amp 1204. Resistors R5*b*, R6*b*, and R7*b* form a voltage divider network that set the limit windows of the window comparator to about 5.5 and 6.5 volts. The RC network 1210 consists of the paralleled capacitor C1*b* and resistor R8*b*.

The invention so far described has used an inductive coupling scheme for sensing current along a gas pipe, as well as a direct voltage measuring scheme. Each of these separate sensing systems generate what is essentially an analog "1" condition if electrical current is detected on the gas feeder pipe 1011 by way of inductive coupling or by resistive voltage drop.

Figure 13B:
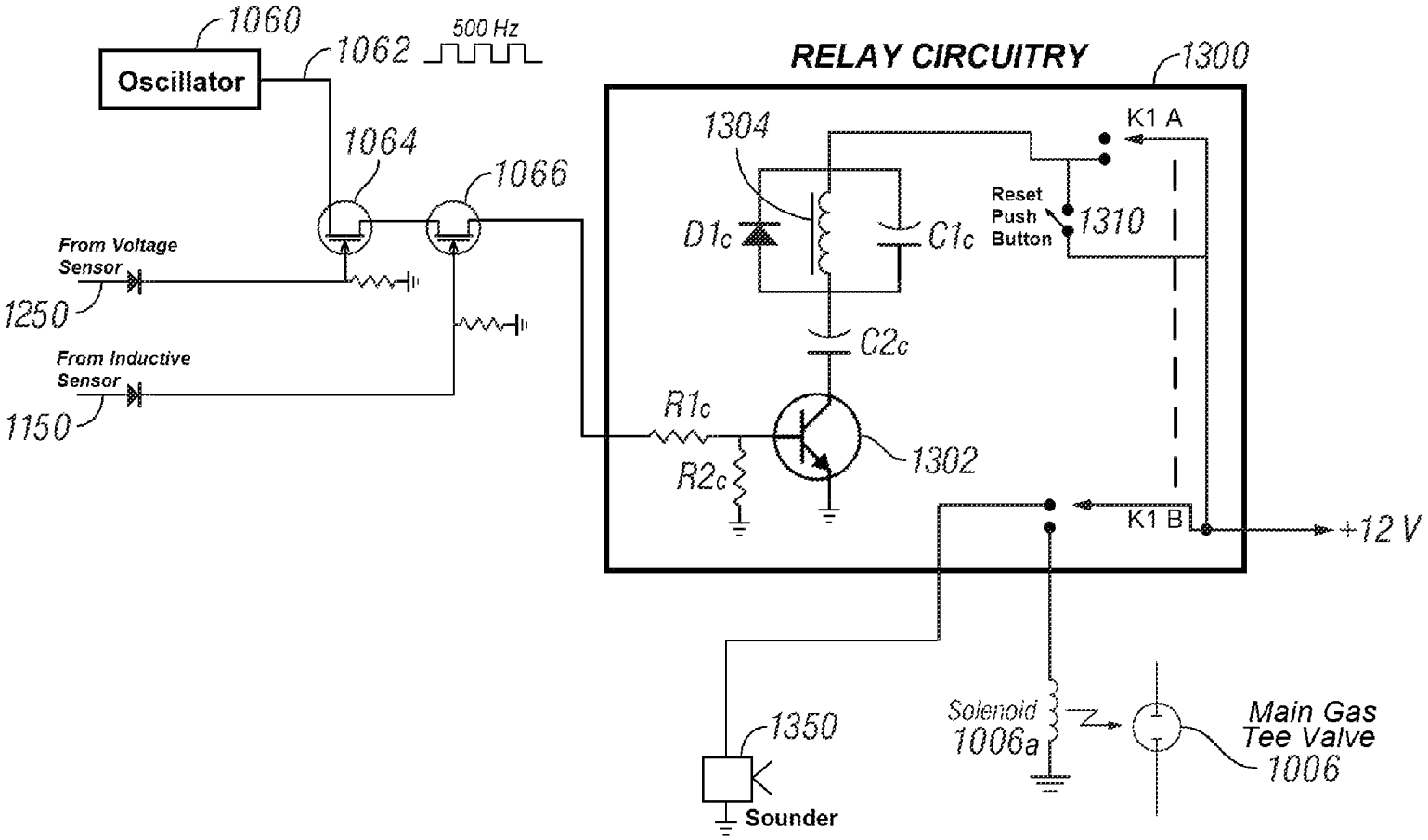
FIG. 13*b* is a detailed circuit diagram of an embodiment of the relay circuitry in the embodiment of the electrical failsafe system shown in FIG. 10*b* in accordance with the present invention.

With reference now to FIG. 13*b*, should either the inductive coupling 1100 or the resistance 1200 method detect a signal on the gas feeder pipe 1011, corresponding to current flow along the gas feeder pipe 1011, then the desired response is for the system to cut the gas flow off. Gas flow through the system is maintained by the main gas tee valve 1006 and its solenoid 1006*a*. In order to allow gas flow, a pulse train of square waves is produced by a 555 timer/oscillator denoted as 1060. The output 1062 of timer/oscillator 1060, a continual pulse train, is gated to a transistor base (transistor 1302) by two FETs, 1064 and 1066. The FETs 1064 and 1066 are used in an analog switch mode. The gate voltage is controlled by the respective outputs 1150, 1250 from the induction coupling system 1100 and the voltage drop detection system 1200. So long as no substantive current is flowing on the gas piping system, both FETS 1064 and 1066 will be shorts, and will conduct the square wave from 555 timer 1060 to the base of the drive transistor 1302 in the relay circuitry 1300.

Transistor 1302, driven by the pulse train, is a common emitter drive transistor, used to energize the coil of relay 1304. The circuit for the coil on relay 1304 has in parallel with it a free wheeling diode D1*c* and an electrolytic capacitor C1*c*. In addition, the coil for relay 1340 has in series with it a large blocking capacitor C2*c*.

The blocking capacitor C2*c* insures that damage to transistor 1302 (e.g., in the form of a short) will cause the coil of relay 1304 to lose current by the capacitor's blocking action. Likewise, electrical damage to the timer circuit (timer 1060) will cause square wave generation to cease. When this occurs, the current in the coil of relay 1304 ceases, causing the relay contacts on relay 1304 to open. When the relay contacts on relay 1304, open power is removed from the main gas tee valve 1006 causing gas flow to downstream appliances to cease. The contacts on relay 1304 act as a latch, insuring that power to the main gas tee valve 1006 is not restored without manual intervention, i.e., pushing the reset push-button 1310.

The purpose of the 'tee' action on main gas tee valve 1006 is to relieve the residual internal pressure of the gas piping system downstream from the main gas tee valve 1006 while closing off the supply of gas to the system. In the event of an electrical lightning discharge, the solenoid 1006*a* on the main gas tee valve 1006 loses power, causing the main gas tee valve 1006 to revert to a second configuration, which blocks gas flow from the utility supply to the gas manifold. However, the downstream gas piping system 1020 and appliances are still under residual pressure. In the event that lightning has created a hole in the CSST or GAC, the pressurized gas will escape under pressure from that hole. By opening this downstream pressurized gas line and manifold to open air and venting the gas pressure to the atmosphere, the release of pressurized gas at the newly created hole is minimized. The 'tee' action of the gas valve insures that the manifold and the downstream gas appliances are only connected to either the gas supply or to open air regardless of the configuration. The use of a two-way valve in the main gas tee valve 1006 insures that the gas supply/utility pressure never flows straight to open air (i.e., the atmosphere).

Figure 14A:
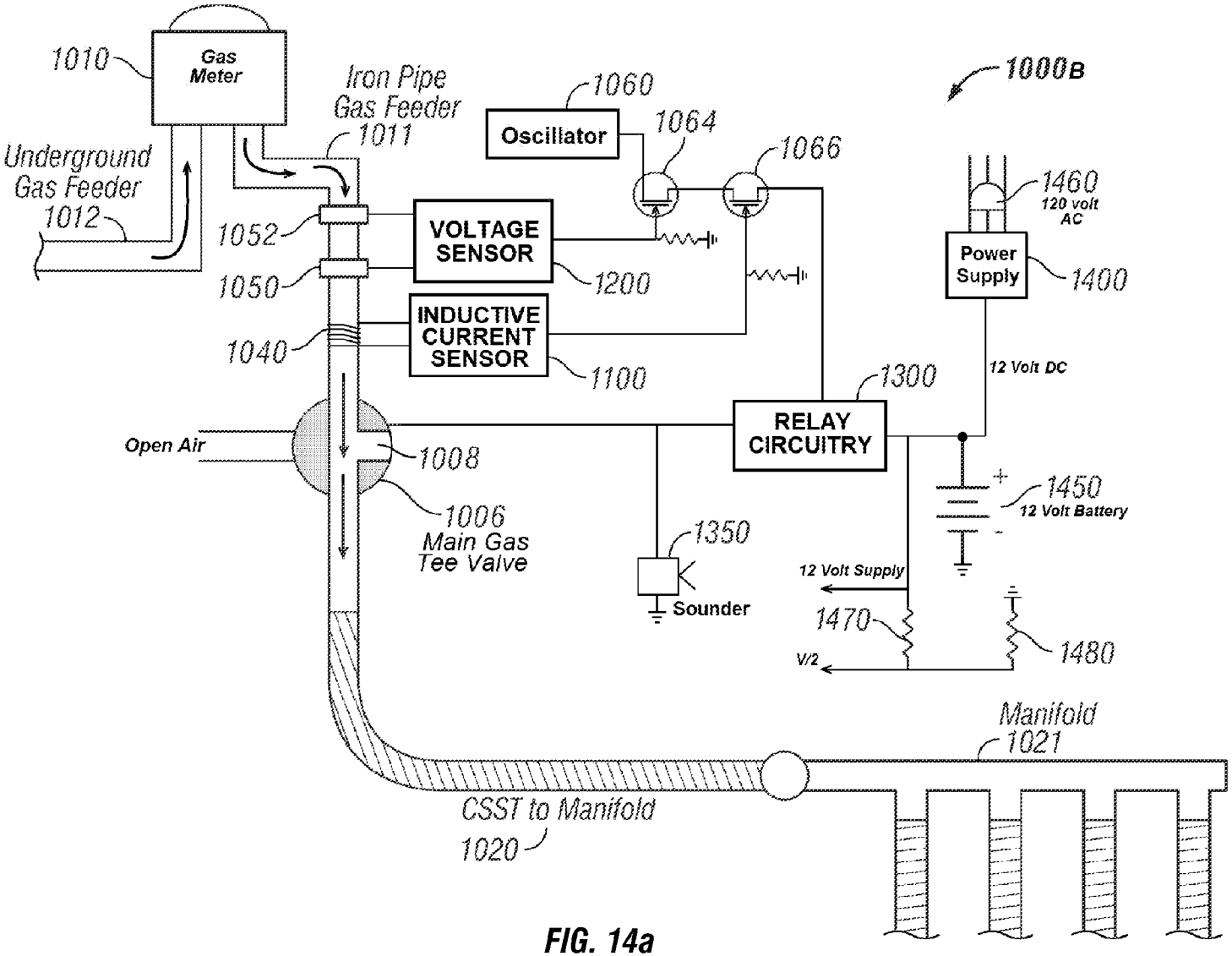
FIG. 14*a* shows the enhanced alternate embodiment of the electrical failsafe system of the present invention shown in FIG. 10*b* incorporating a residual gas dispersal system, which features a tee valve mechanism configured in a first position.
Figure 14B:
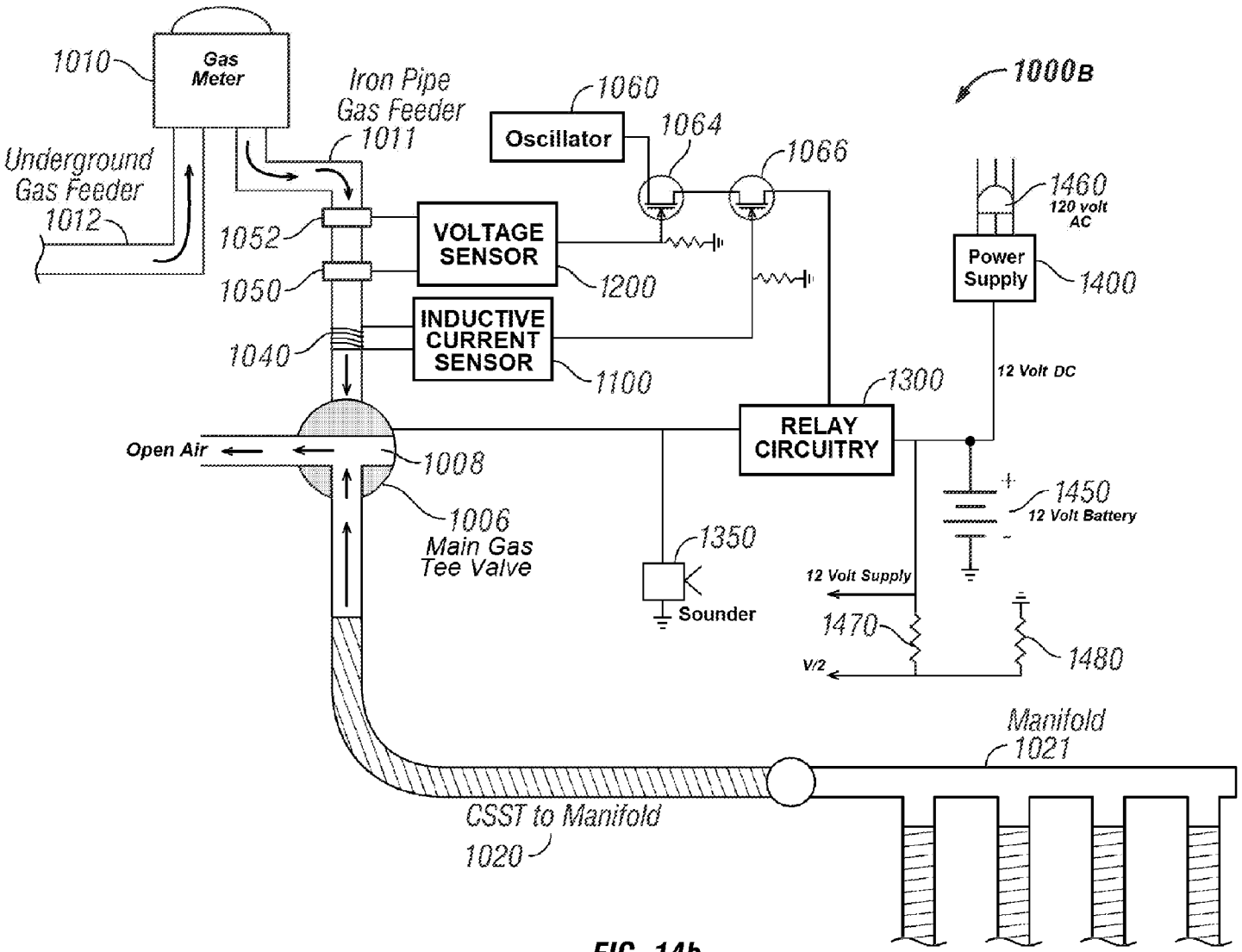
FIG. 14*b* shows the enhanced alternate embodiment of the electrical failsafe system of the present invention shown in FIG. 10*b* incorporating a residual gas dispersal system, which features a tee valve mechanism configured in a second position.

For example, as shown in FIG. 14*a*, during normal operation the main gas tee valve 1006 is positioned in a first configuration, which permits the flow of gas from the utility supply to the CSST piping system 1020 and gas manifold 1021. The main gas tee valve 1006 includes a tee-shaped passageway 1008, which channels the flow of gas from the utility supply feeder pipe 1011 to the CSST piping system 1020 and gas manifold 1021 when configured in a first position as shown in FIG. 14*a*. Gas flow through the system is maintained by the main gas tee valve 1006 configured in the first position by its energized solenoid 1006*a*. In order to maintain the flow of the gas through the main gas tee valve 1006, a pulse train of square waves is produced by a 555 timer/oscillator denoted as 1060 as noted previously. However, in the event of an electrical lightning discharge, the solenoid 1006*a* on the main gas tee valve 1006 loses power, causing the tee-shaped passageway 1008 within the main gas tee valve 1006 to revert to a second configuration (shown in FIG. 14*b*), which blocks the flow of gas from the utility supply to the gas manifold and vents residual gas pressure from the downstream gas piping system 1020 to the open air (i.e., the atmosphere).

The system 1000B may also include a push-button to manually reset the system in case electrical energy energizes the gas line resulting in the gas flow being shut off. The push-button 1310 is a momentary push-button used to restore power to the coil of the latching relay 1304 after the unit has detected electrical current and opened up.

The system 1000B may also include an audible alarm to alert the user of gas interruption by use of an audible sounding device. In a preferred embodiment, the audible sounding device comprises a buzzer mechanism or sounder 1350 to alert the user that the system 1000B has actuated, with said buzzer mechanism 1350 sounding continuously, or until electrical power to the system 1000B is unavailable.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated. It will be understood by one of ordinary skill in the art that numerous variations will be possible to the disclosed embodiments without going outside the scope of the invention as disclosed in the claims. For example, there are many embodiments of two-way valves which are suitable for use as the main gas tee valve besides the ball-type tee valve depicted in the Figures.

I claim:

1. An apparatus for preventing electrically induced fires in gas tubing, comprising:

(a) a sensor mechanism for detecting electrical insults to a gas tubing system;

(b) an automated gas cut-off system that stops the flow of gas from a gas feeder pipe to the gas tubing system in response to a detection of an electrical insult by the sensor mechanism, wherein said automated gas cut-off system comprises a two-way valve configured between the gas feeder pipe and the gas tubing system, said two-way valve having a first position, which fluidly connects the gas feeder pipe to the gas tubing system; and a second position, which fluidly blocks the gas feeder pipe from the gas tubing system and fluidly connects the gas tubing system to open air.

2. The apparatus of claim 1, wherein said wherein said two-way valve includes a solenoid and is biased to the second position when said solenoid is not energized.

3. The apparatus of claim 2, wherein the two-way valve comprises a ball valve mechanism having a tee-shaped passageway.

4. The apparatus of claim 1, wherein the automated gas cut-off system includes control circuitry electrically coupling said sensor mechanism to said two-way valve that controls the flow of gas to said gas tubing system, said two-way valve including a solenoid coupled to said control circuitry.

5. The apparatus of claim 1, wherein the sensor mechanism comprises an inductive current sensor system attached to a gas feeder pipe.

6. The apparatus of claim 5, wherein the sensor mechanism further comprises a voltage sensor system attached to said gas feeder pipe.

7. The apparatus of claim 1, wherein the sensor mechanism comprises a voltage sensor system attached to a gas feeder pipe.

8. The apparatus of claim 1, wherein the automated gas cut-off system includes control circuitry coupled to said sensor mechanism, said control circuitry including a latching relay system that monitors a continual AC pulse train.

9. The apparatus of claim 8, wherein detection of an electrical insult by said sensor mechanism causes an interruption of the continual AC pulse train.

10. The apparatus according to claim 1, wherein the automated gas cut-off system stops the flow of gas by de-energizing a solenoid controlling the two-way valve causing the two-way valve to revert to the second position.

11. An apparatus for preventing electrically induced fires in gas tubing, comprising:

(a) a sensor mechanism for detecting electrical insults to a gas tubing system;

(b) control circuitry coupled to said sensor mechanism;

(c) a two-way valve that controls the flow of gas from a gas feeder pipe to said gas tubing system, said two-way gas valve including a solenoid coupled to said control circuitry; said two-way valve having a first position, which fluidly connects said gas feeder pipe to the gas tubing system; and a second position, which fluidly blocks the gas feeder pipe from the gas tubing system and fluidly connects the gas tubing system to open air;

wherein the two-way valve is configured in the first position so long as the control circuitry supplies a continuous electrical current to the solenoid; and the second position when the control circuitry switches off the electrical current to the solenoid in response to an electrical surge detected by said sensor mechanism.

12. The apparatus according to claim 11, wherein the configuration of the two-way valve is biased to the second position when the solenoid is not energized.

13. The apparatus according to claim 11, wherein the sensor mechanism comprises an inductive current sensor system attached to a gas feeder pipe.

14. The apparatus according to claim 13, wherein the sensor mechanism further comprises a voltage sensor system attached to said gas feeder pipe.

15. The apparatus according to claim 11, wherein the sensor mechanism comprises a voltage sensor system attached to a gas feeder pipe.

16. The apparatus according to claim 11, wherein the control circuitry includes a latching relay system that monitors a continual AC pulse train.

17. The apparatus according to claim 16, wherein the continual AC pulse train is generated by an oscillator in the control circuitry.

18. The apparatus according to claim 17, wherein detection of an electrical surge by said sensor mechanism causes an interruption of the continual AC pulse train.

19. The apparatus according to claim 11, further comprising an audible sounding device which the control circuitry energizes when the solenoid is de-energized in response to the electrical surge detected by said sensor mechanism.

20. The apparatus according to claim 11, wherein power may be manually restored to the solenoid by a reset pushbutton.

21. A method for preventing electrically induced fires in a gas tubing system, comprising:

(a) attaching a sensor mechanism to a gas feeder pipe;

(b) electrically coupling said sensor mechanism to control circuitry having a latching relay mechanism, wherein said control circuitry generates a continuous signal to said latching relay mechanism, which causes a solenoid in a two-way main gas valve to be energized in a first position, which fluidly connects the gas feeder pipe to the gas tubing system;

wherein in response to an electrical surge detected by said sensor mechanism, the control circuitry blocks the continuous signal to said latching relay mechanism, which causes said solenoid in the two-way main gas valve to be de-energized causing said two-way main gas valve to revert to a second position, which fluidly blocks the gas feeder pipe from the gas tubing system and vents residual gas in the gas tubing system to open atmosphere.

22. The method of claim 21, wherein the sensor mechanism comprises an inductive current sensor system.

23. The method of claim 22, wherein the sensor mechanism further comprises a voltage sensor system.

24. The method of claim 21, wherein the sensor mechanism comprises a voltage sensor system.

25. The method of claim 21, wherein the continuous signal comprises a continual AC pulse train.

26. The method of claim 25, wherein the continuous signal is generated by an oscillator in the control circuitry.

27. The method of claim 21, wherein the control circuitry further energizes an audible sounding device in response to blocking the continuous signal to said latching relay mechanism.

28. A method for preventing electrically induced fires in gas tubing, comprising:

(a) detecting an electrical insult to a gas tubing system using an automated Sensor mechanism;

(b) automatically actuating a two-way main gas valve in a gas cut-off system to stop the flow of gas from a gas feeder pipe to the gas tubing system and vent residual gas pressure in the gas tubing system to the atmosphere in response to a detection of an electrical insult by the sensor mechanism.

* * * * *